US009656470B2

(12) United States Patent
Kobayashi et al.

(10) Patent No.: US 9,656,470 B2
(45) Date of Patent: May 23, 2017

(54) LIQUID EJECTING HEAD AND LIQUID EJECTING APPARATUS

(71) Applicant: Seiko Epson Corporation, Tokyo (JP)

(72) Inventors: Hiroyuki Kobayashi, Azumino (JP); Hiroyuki Hagiwara, Matsumoto (JP); Toshinobu Yamazaki, Niigata (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/040,012

(22) Filed: Feb. 10, 2016

(65) Prior Publication Data

US 2016/0257118 A1 Sep. 8, 2016

(30) Foreign Application Priority Data

Mar. 3, 2015 (JP) ..... 2015-041540

(51) Int. Cl.
*B41J 2/14* (2006.01)
*B41J 2/045* (2006.01)

(52) U.S. Cl.
CPC ..... *B41J 2/1433* (2013.01); *B41J 2/04541* (2013.01); *B41J 2/14233* (2013.01); *B41J 2002/14419* (2013.01); *B41J 2002/14491* (2013.01)

(58) Field of Classification Search
CPC ..... B41J 2/14072; B41J 2002/14491
See application file for complete search history.

(56) References Cited

U.S. PATENT DOCUMENTS 6,074,040 A * 6/2000 Usui ..... B41J 2/14233 347/45
6,371,597 B1 * 4/2002 DeMeerleer ..... B41J 2/14072 347/50
2005/0270339 A1 * 12/2005 Sugahara ..... B41J 2/14233 347/68
2007/0090898 A1 4/2007 Kando
2007/0165071 A1 7/2007 Hirota
2007/0296753 A1 * 12/2007 Ito ..... B41J 2/04541 347/19
2008/0316274 A1 12/2008 Kondo
2009/0284569 A1 * 11/2009 Kawaguchi ..... B41J 2/14209 347/68
2011/0211024 A1 * 9/2011 Kawamura ..... B41J 2/14072 347/58
2011/0242190 A1 10/2011 Suzuki et al.
2013/0083102 A1 * 4/2013 Kondo ..... B41J 2/14209 347/9
2016/0114582 A1 * 4/2016 Hagiwara ..... B41J 2/14233 347/50

FOREIGN PATENT DOCUMENTS

JP 2003-011383 A 1/2003
JP 2005-225219 A 8/2005
(Continued)

*Primary Examiner* — Shelby Fidler
(74) *Attorney, Agent, or Firm* — Harness, Dickey & Pierce, P.L.C.

(57) ABSTRACT

A liquid ejecting head includes a driving element for ejecting a liquid from a nozzle; a wiring electrically connected to the driving element; an accommodation space that accommodates at least a portion of the wiring; and dummy wirings which are arranged in the accommodation space and adsorb sulfur.

20 Claims, 15 Drawing Sheets

(56) References Cited

FOREIGN PATENT DOCUMENTS

| | | | |
|---|---|---|---|
| JP | 2005-254546 | A | 9/2005 |
| JP | 2006-272885 | A | 10/2006 |
| JP | 2007-190738 | A | 8/2007 |
| JP | 2009-000978 | A | 1/2009 |
| JP | 2009-290914 | A | 12/2009 |
| JP | 2011-207181 | A | 10/2011 |
| JP | 2012-213974 | A | 11/2012 |

* cited by examiner

LIQUID EJECTING HEAD AND LIQUID EJECTING APPARATUS

BACKGROUND

1. Technical Field

The present invention relates to a liquid ejecting head and a liquid ejecting apparatus that eject a liquid from a nozzle, and, in particular, relates to an ink jet recording head and an ink jet recording apparatus that eject ink as a liquid.

2. Related Art

Representative examples of liquid ejecting heads that eject a liquid include ink jet recording heads that eject ink. An ink jet recording head equipped with a plurality of head main bodies that eject ink from nozzles and a common liquid introduction member (corresponds to a storage member) that supplies ink to each head main body from a liquid storage member in which the ink is stored fixed to the plurality of head main bodies is proposed (for example, refer to JP-A-2005-225219).

The ink jet recording head includes a circuit substrate connected to a pressure generating unit such as a piezoelectric actuator by which pressure changes are generated in a pressure generating chamber of the head main body (for example, refer to JP-A-2006-272885).

In the ink jet recording head in JP-A-2006-272885, the circuit substrate is held between a case that holds the flow channel unit (corresponds to the head main body) and an introduction needle unit.

However, when ink attaches to the circuit substrate, short circuits and the like of the wiring provided in the circuit substrate occur, and operation defects or failures occur.

Therefore, an ink jet recording head in which the circuit substrate is sealed in a plastic case having an opening large enough for the connection wiring connected to the circuit substrate to pass through is proposed (for example, refer to JP-A-2003-11383).

An ink jet recording head in which the circuit substrate is protected from ink by an insulating film, an adhesive or the like is proposed (for example, refer to JP-A-2009-978).

However, in a case where a butyl rubber having resistance to a solvent-based ink that includes a solvent is used in a wiping blade that wipes the liquid ejecting surface or a tube that supplies or discharges ink, a problem arises where sulfur added to the butyl rubber by the vulcanization process is generated as an outgas, corrosion products (sulfides) attach to the wiring by the sulfur reacting to silver or copper included in the wiring, and wirings adjacent to one another short circuit.

A problem arises where sulfur included in the insulating material such as a resist that covers the wiring by the solvent included in the solvent-based ink is generated as an out gas, and corrosion products (sulfides) attach to the wiring by the sulfur reacting the silver or copper included in the wiring.

A further problem arises where the copper, silver or the like at the original location is lost, and a cavity is formed, thereby causing a disconnection, when the corrosion products (sulfides) are generated.

In particular, when the wiring connected to the pressure generating unit short circuits due to the sulfide, a plurality of pressure generating units connected to the shorted wiring are driven at the same time, and ink is ejected at the same time. An ink ejection defect arises when the wiring is disconnected due to the sulfide.

Such a problem is similarly present not only in an ink jet recording head, but also in liquid ejecting heads that eject liquids other than ink.

SUMMARY

An advantage of some aspects of the invention is to provide a liquid ejecting head and a liquid ejecting apparatus in which short circuits or disconnection due to the attachment of sulfides to the wiring is suppressed.

Aspect 1

According to an aspect of the invention, there is provided a liquid ejecting head including a driving element for ejecting a liquid from a nozzle; a wiring electrically connected to the driving element; an accommodation space that accommodates at least a portion of the wiring; and a dummy wiring which is arranged in the accommodation space and adsorbs sulfur.

In this aspect, by sulfur in the accommodation space being adsorbed on the dummy wiring, it is possible for adsorption of the sulfur to the wiring to be suppressed, and possible for the occurrence of short circuits or disconnections in the wiring due to the sulfide generated by adsorption of the sulfur to the wiring to be suppressed.

Aspect 2

In the liquid ejecting head according to Aspect 1, it is preferable that the dummy wiring configures a portion of a detection unit, and the detection unit differentiates a detection result according to the extent of a reaction between the dummy wiring and the sulfur. Thereby, it is possible to predict defects due to sulfur on the wiring by detecting the extent of the reaction with the sulfur of the dummy wiring.

Aspect 3

In liquid ejecting head according to Aspect 1 or 2, it is preferable that a plurality of each of the dummy wirings and the wirings is provided, and the narrowest gap between the dummy wirings adjacent to one another is narrower than the narrowest gap between the wirings adjacent to one another. Thereby, because the dummy wiring short circuits before the wiring short circuits due to the sulfide, it is possible to predict short circuiting of the wiring by detecting the conductivity of the dummy wiring.

Aspect 4

In the liquid ejecting head according to any one of Aspects 1 to 3, it is preferable that at least a portion of the dummy wiring and the wiring is provided on a common rigid substrate. Thereby, by providing the wiring and the dummy wiring on a common rigid substrate, it is possible to both reduce the costs and achieve size reductions by reducing the number of components.

Aspect 5

In the liquid ejecting head according to Aspect 4, it is preferable that the rigid substrate is connected to a flexible cable that is connected to the driving element from the wirings, and the dummy wiring is provided on the surface of an opposite side to the surface to which the flexible cable is connected. Thereby, it is possible to provide the dummy wiring in as wide an area as possible in a region other than the region in which the wiring connected to the flexible cable of the rigid substrate is provided.

Aspect 6

In the liquid ejecting head according to Aspect 5, it is preferable that the accommodation space includes a first accommodation space that accommodates the rigid substrate, and a second accommodation space that accommodates the flexible cable, the rigid substrate includes a through port that the flexible cable passes through, a rib that supports the rigid substrate from a surface on an opposite side to a surface of the side to which the flexible cable is bonded from both surfaces of the rigid substrate is provided in the first accommodation space, and the rib causes the rigid substrate to be separated from a wall surface of the first accommodation space. Thereby, it is possible for the surface of the rigid substrate on which the dummy wiring is provided to be separated from the wall surface of the first accommodation space by the rib, and possible for the exposed surface area of the dummy wiring to be increased and the adsorption of the sulfur to be efficiently performed.

Aspect 7

In the liquid ejecting head according to Aspect 6, it is preferable that the accommodation space includes an exit port closer to the first accommodation space than the second accommodation space, and the rib is provided along an edge of the through port and a notch is provided on a side of the rib far from the exit port of the accommodation space of the through port. Thereby, it is possible to discharge the sulfur in the accommodation space from the exit port, and possible to distance the second accommodation space from the exit port by providing the notch of the rib on the side far from the exit port. Accordingly, it is possible for the sulfur to less easily enter the second accommodation space and possible to lengthen the time that the sulfur in the second accommodation space contacts the dummy wiring.

Aspect 8

In the liquid ejecting head according to Aspect 6 or 7, it is preferable that a seal member that blocks the through port of the rigid substrate from a surface of the side to which the flexible cable is bonded from both surfaces of the rigid substrate is provided in the second accommodation space. Thereby, it is possible to suppress infiltration of the sulfur into the through port.

Aspect 9

In the liquid ejecting head according to any one of Aspects 1 to 8, it is preferable that the dummy wiring is grounded. Accordingly, it is possible to suppress the occurrence of noise due to floating metal by grounding the dummy wiring.

Aspect 10

In the liquid ejecting head according to any one of Aspects 6 to 8, it is preferable that a filler that covers at least a portion of the flexible cable is provided in the second accommodation space. Thereby, it is possible to inhibit the sulfide attached to the dummy wiring from dropping to the flexible cable side with the filler, and to inhibit the wiring of the flexible cable from shorting due to the dropped sulfide.

Aspect 11

In the liquid ejecting head according to any one of Aspects 1 to 10, it is preferable that convexities and concavities are formed in the surface of the dummy wiring. Thereby, it is possible for the exposed surface area of the dummy wiring to be increased and the adsorption of the sulfur to be efficiently performed.

Aspect 12

According to another aspect of the invention, there is provided a liquid ejecting apparatus including the liquid ejecting head according to any one of Aspects 1 to 11.

In this aspect, it is possible to realize a liquid ejecting apparatus in which sulfides are inhibited from being generated in the wiring, and short circuits and disconnections are suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed description is provided below based on the embodiments.

Embodiment 1

Figure 1:
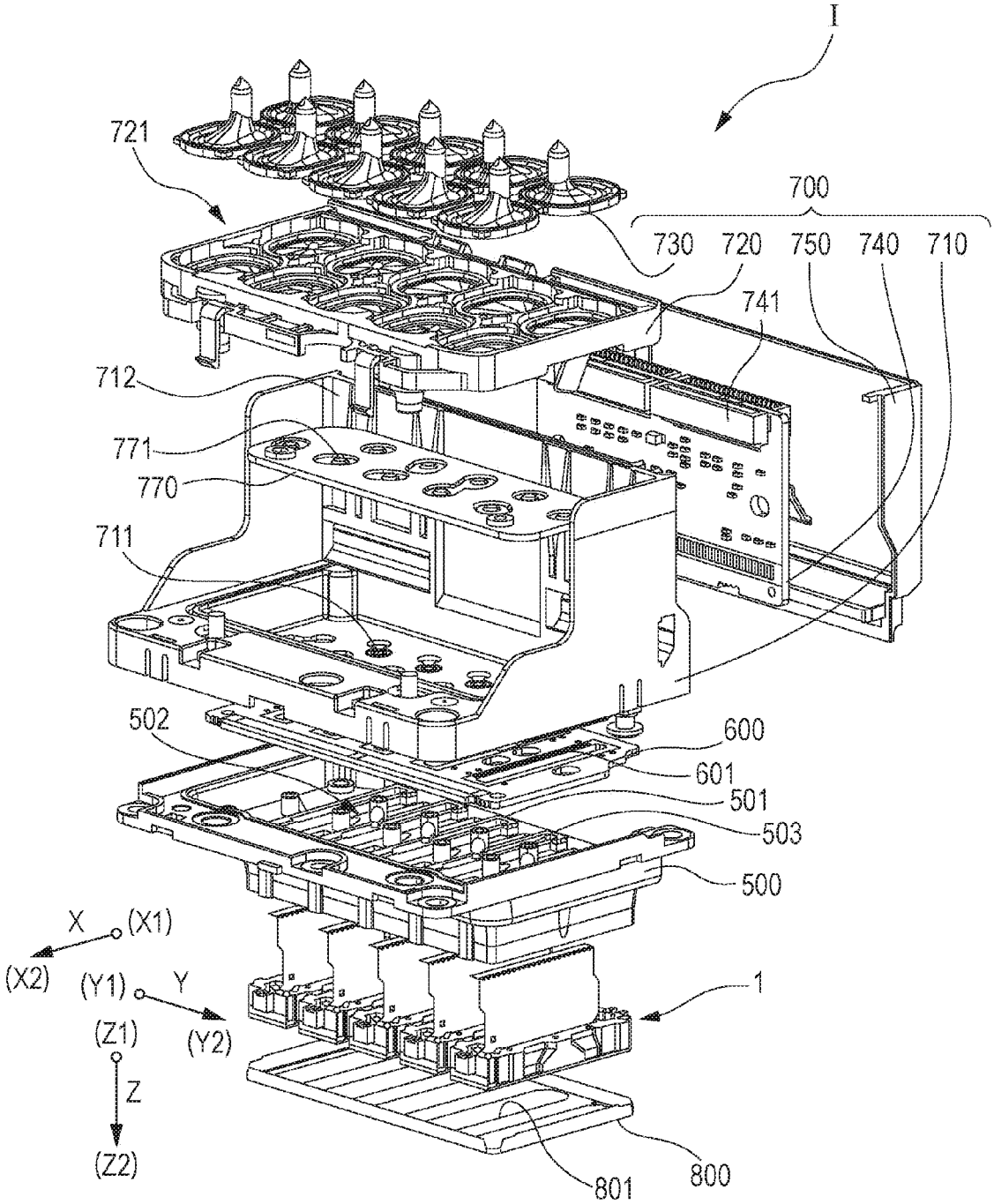
FIG. 1 is an exploded perspective view of a recording head according to Embodiment 1 of the invention.
Figure 2:
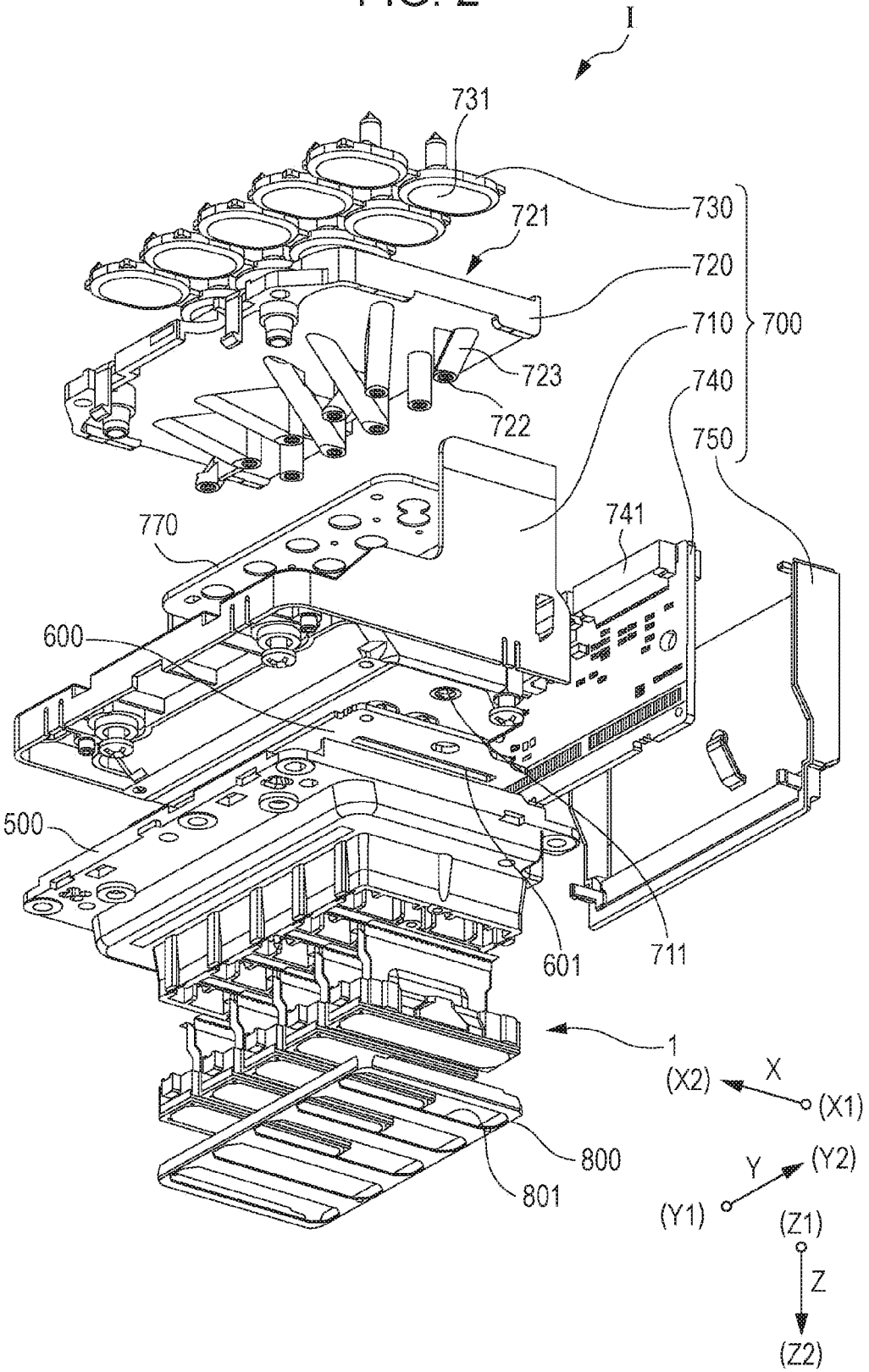
FIG. 2 is an exploded perspective view of the recording head according to Embodiment 1 of the invention.

FIGS. 1 and 2 are perspective views of an ink jet recording head that is an example of a liquid ejecting head according to Embodiment 1 of the invention. As shown in FIGS. 1 and 2, the ink jet recording head I (below, also referred to as recording head I) is equipped with a head main body 1, a supply channel forming member 500 to which a plurality of head main bodies 1 is fixed, a circuit substrate 600 provided on the opposite side of the supply channel forming member 500 to the head main body 1, a fixed member 700 provided on the circuit substrate 600 side of the supply channel forming member 500, and a cover head 800 provided on the opposite side of the head main body 1 to the supply channel forming member 500.

Figure 3:
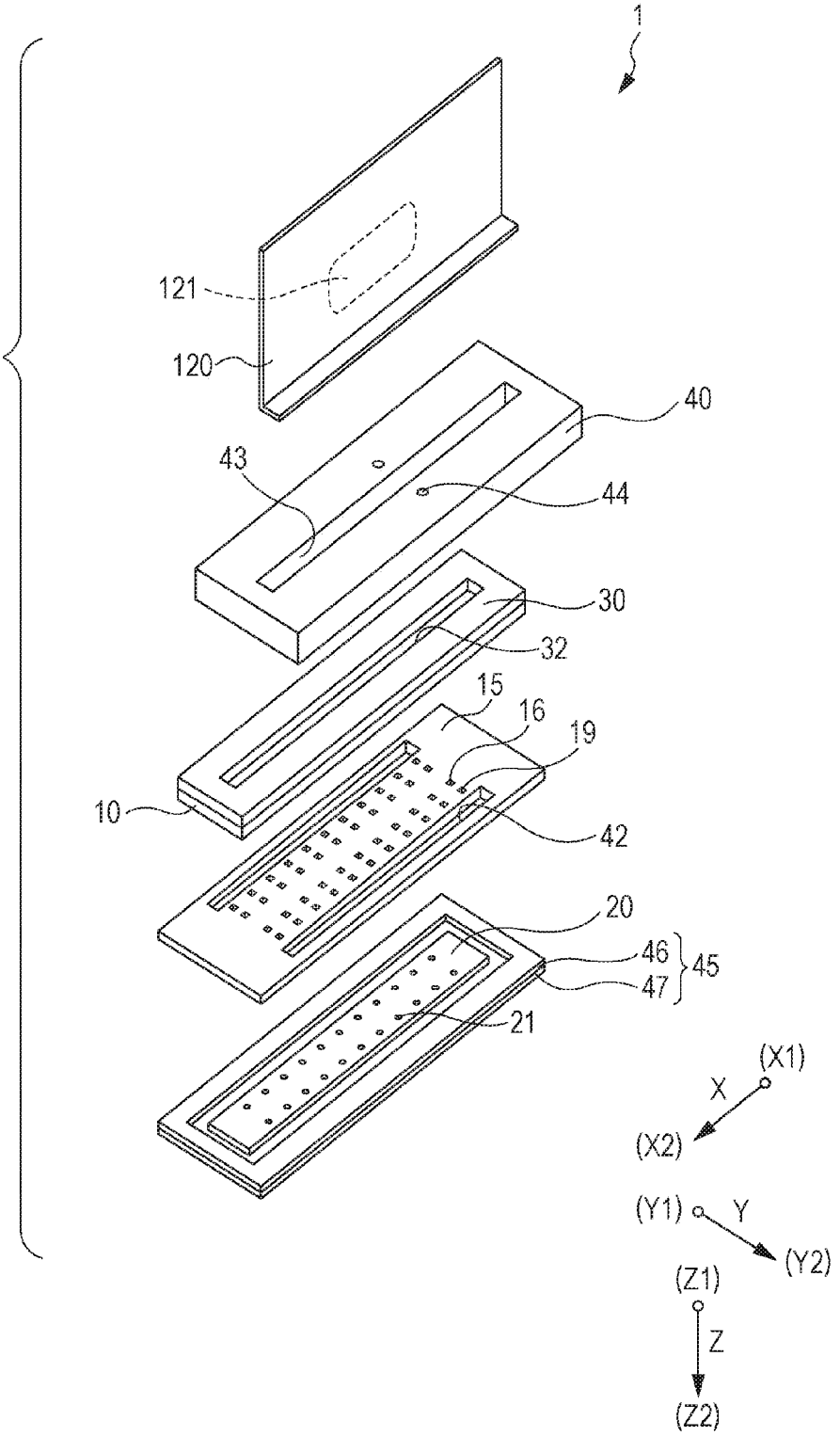
FIG. 3 is an exploded perspective view of a head main body according to Embodiment 1 of the invention.
Figure 4:
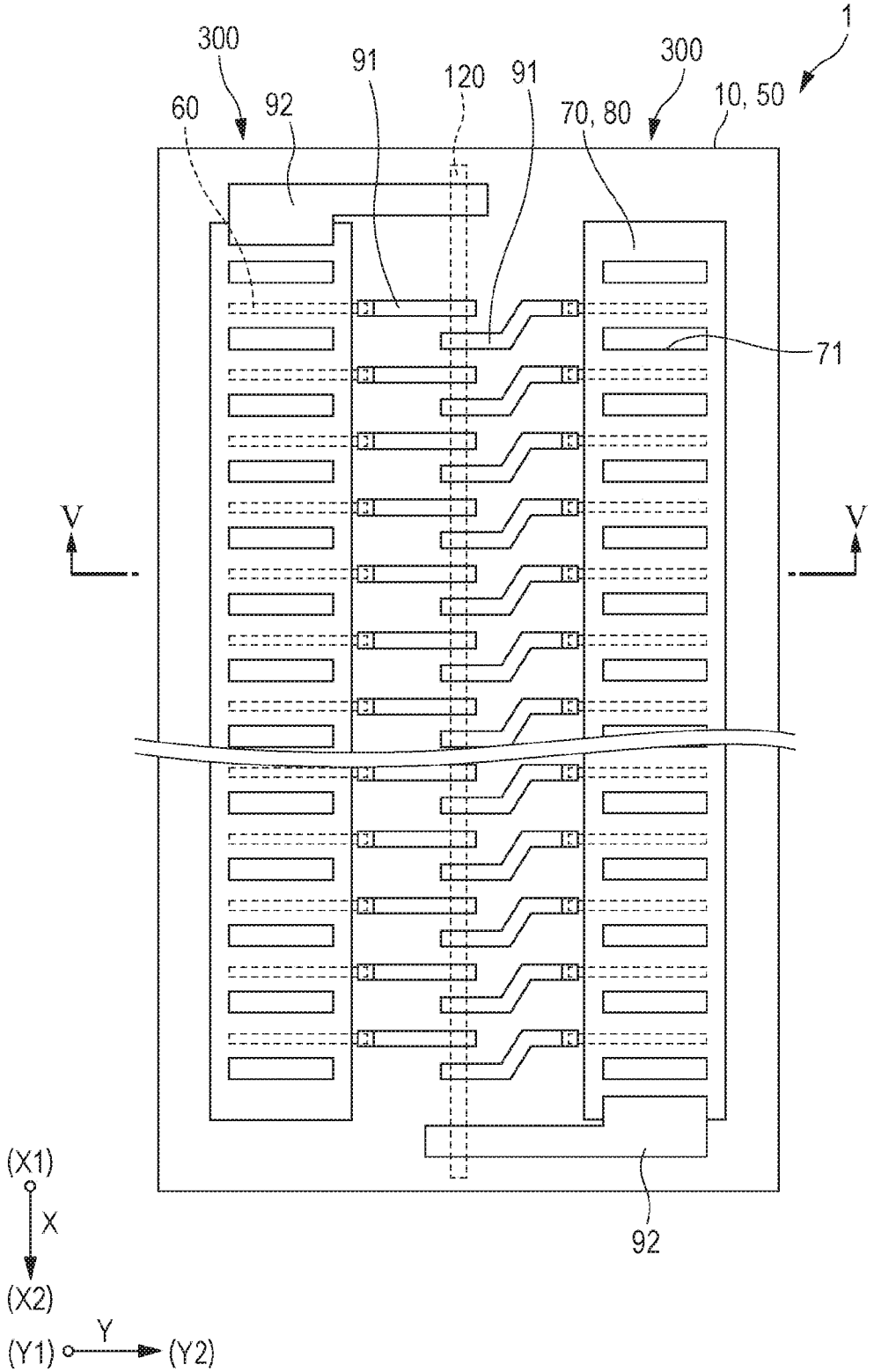
FIG. 4 is a plan view of a head main body according to Embodiment 1 of the invention.
Figure 5:
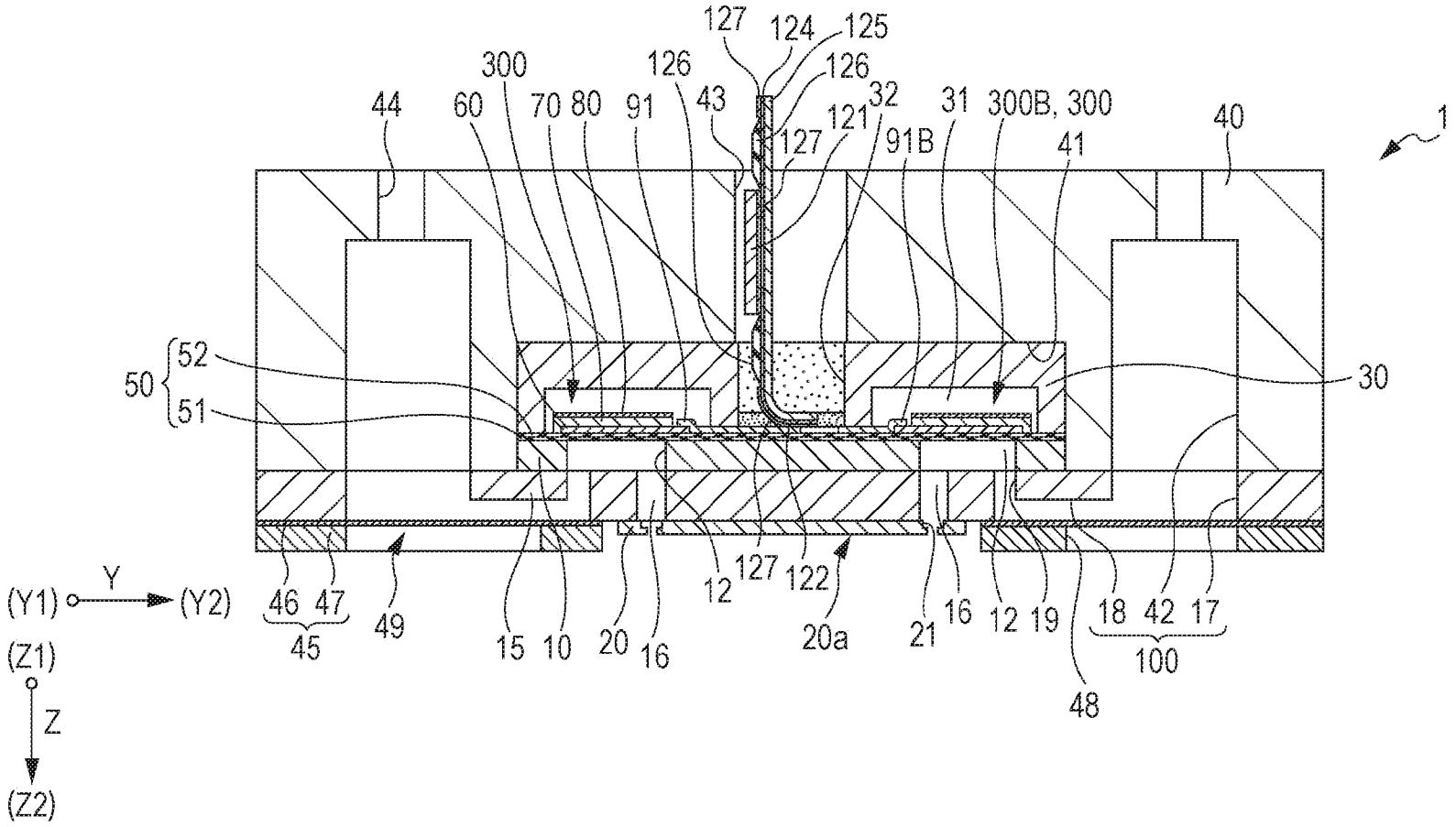
FIG. 5 is a cross-sectional view of a head main body according to Embodiment 1 of the invention.
Figure 6:
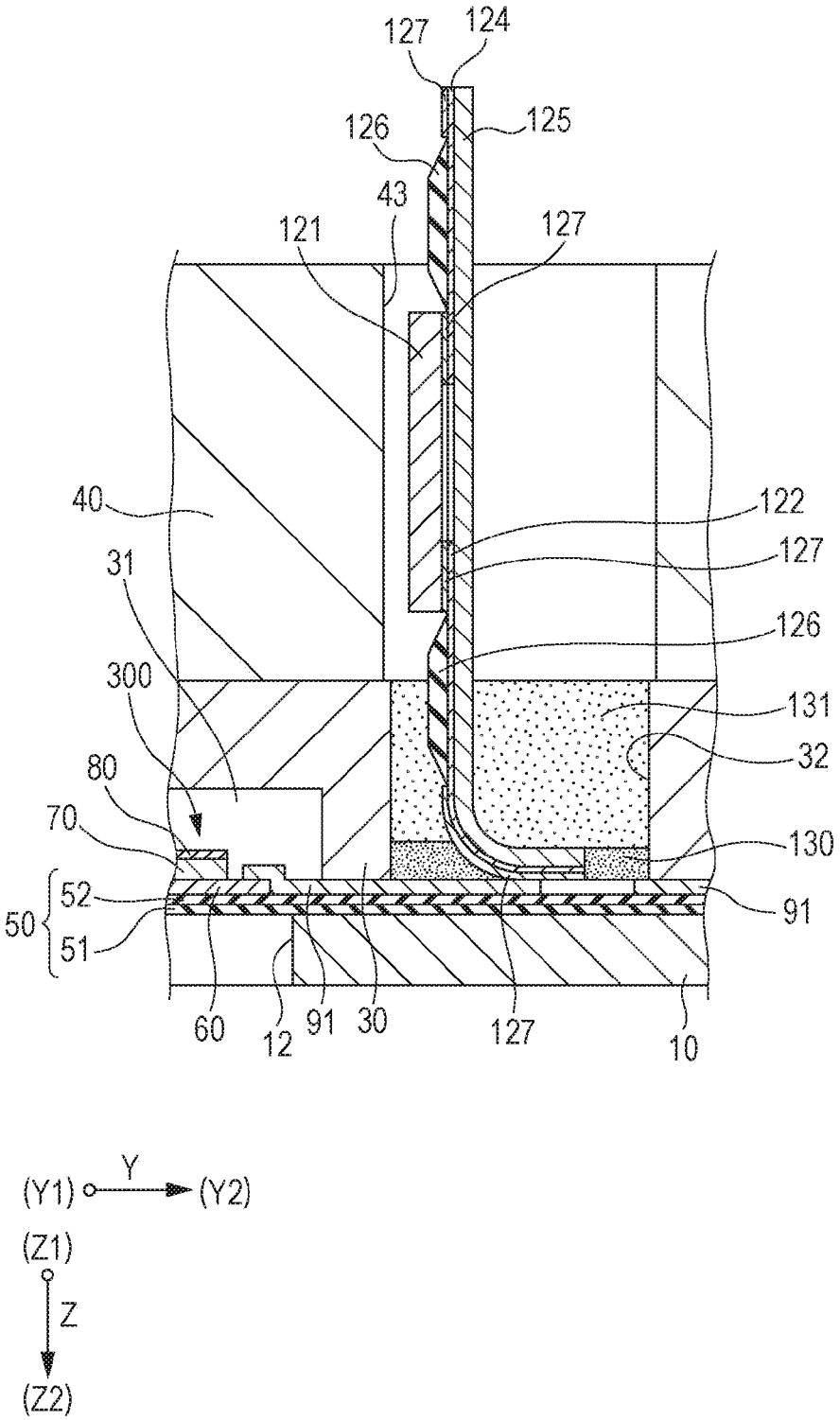
FIG. 6 is a cross-sectional view with the main portions of the head main body according to Embodiment 1 of the invention enlarged.
Figure 7:
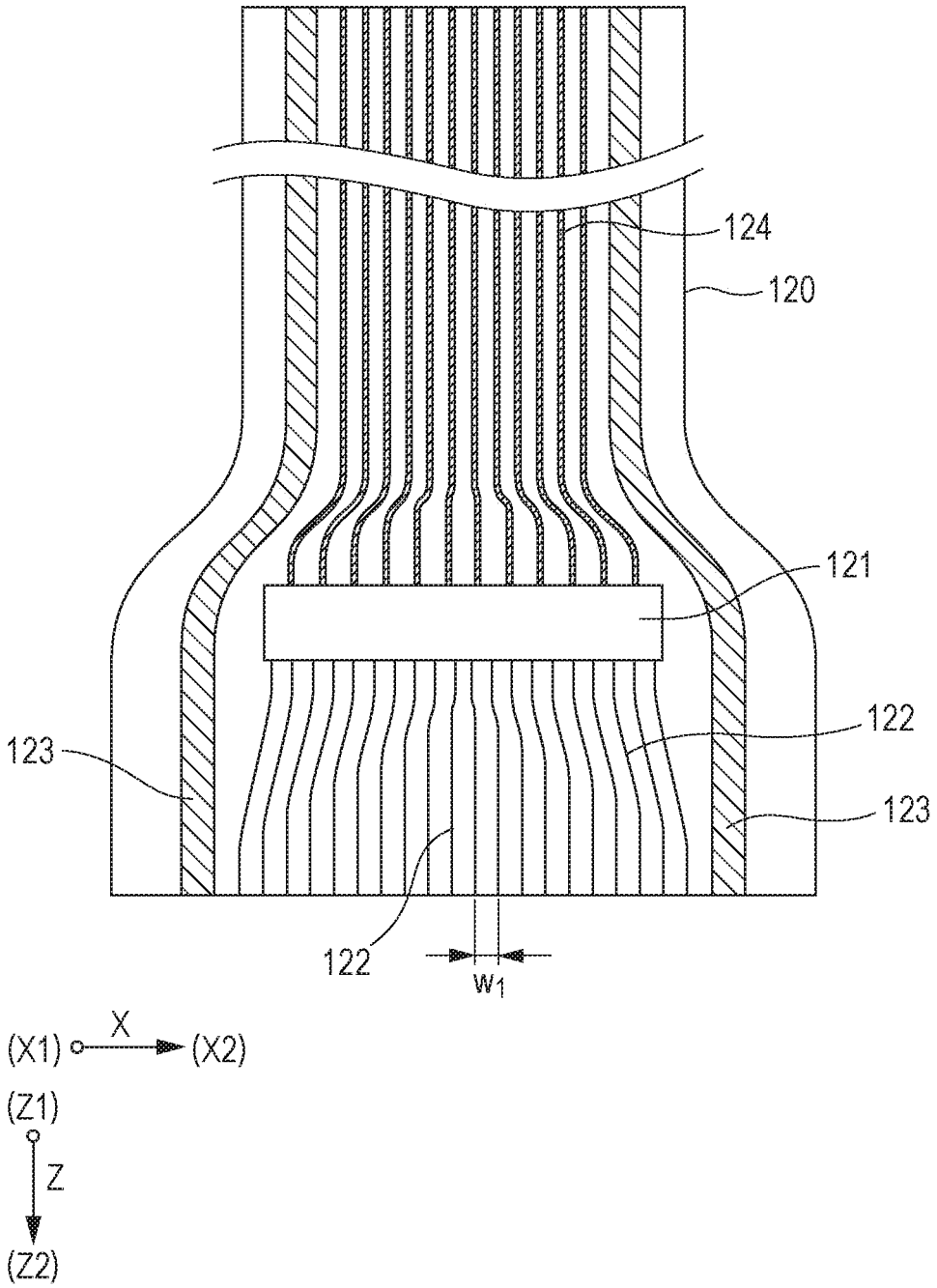
FIG. 7 is a plan view of a flexible cable of the invention.

First, the head main body 1 will be described in detail with reference to FIGS. 3 to 5. FIG. 3 is an exploded perspective view of the head main body according to Embodiment 1 of the invention, FIG. 4 is a plan view of the head main body, FIG. 5 is a cross-sectional view taken along line V-V in FIG. 4, FIG. 6 is a drawing in which the main portions of FIG. 5 are expanded, and FIG. 7 is a plan view of a flexible cable.

As shown in the drawings, by subjecting the flow channel-forming substrate 10 that configures the head main body 1 to anisotropic etching from one surface side, the pressure generating chambers 12 partitioned by a plurality of partition walls is provided in parallel along the direction in which the plurality of nozzles 21 are provided in parallel. Below, this direction is referred to as the arrangement direction of the pressure generating chamber 12, or as the first direction X. A plurality of rows, in the embodiment, two rows, in which the pressure generating chambers 12 are arranged in parallel in the first direction X is provided on the flow channel-forming substrate 10. The arrangement direction in which the plurality of rows of pressure generating chambers 12 are formed along the X direction are arranged is referred to below as the second direction Y. Furthermore, a direction orthogonal to both the first direction X and the second direction Y is referred to as the third direction Z. Although the first direction X, the second direction Y, and the third direction Z are mutually orthogonal directions, there is no particular limitation thereto, and the directions may be directions that intersect each other at angles other than orthogonal.

The communication plate 15 and the nozzle plate 20 are sequentially layered on Z2 that is one surface side in the third direction Z of the flow channel-forming substrate 10.

A nozzle communication path 16 that communicates the pressure generating chamber 12 and the nozzles 21 is provided in the communication plate 15. The communication plate 15 has a larger area than the flow channel-forming substrate 10, and the nozzle plate 20 has a smaller area than the nozzle plate 10. Because the nozzles 21 of the nozzle plate 20 and the pressure generating chamber 12 are separated by providing the communication plate 15 in this way, the ink present in the pressure generating chamber 12 is not easily influenced by thickening due to evaporation of the moisture or solvent components in the ink that arises in ink in the vicinity of the nozzle 21. Since the nozzle plate 20 may simply cover the opening of the nozzle communication path 16 that communicates with the pressure generating chamber 12 and the nozzle 21, it is possible to comparatively reduce the area of the nozzle plate 20, and possible to achieve reductions in cost. In the embodiment, the surface in which the nozzles 21 of the nozzle plate 20 are opened and from which ink is ejected is referred to as the liquid ejecting surface 20*a*.

A first manifold portion 17 and a second manifold portion 18 that configure a portion of the manifold 100 are each provided corresponding to each row of the pressure generating chamber 12 on the communication plate 15.

The first manifold portion 17 is provided penetrating the communication plate 15 in the third direction Z.

The second manifold portion 18 is provided opened to the nozzle plate 20 side of the communication plate 15 without penetrating the communication plate 15 in the third direction Z.

A supply path 19 that communicates with one end portion of the pressure generating chamber 12 in the second direction Y is independently provided for each pressure generating chamber 12 in the communication plate 15. The supply path 19 communicates the second manifold portion 18 and the pressure generating chamber 12. That is, the supply paths 19 are arranged in parallel in the first direction X with respect to the manifold 100.

Nozzle openings 21 that communicate with each pressure generating chamber 12 via the nozzle communication path 16 are formed in the nozzle plate 20. That is, the nozzles 21 that ejected the same type of liquid (ink) are arranged in parallel in the first direction X, and two rows of nozzles 21 arranged in parallel in the first direction X are formed in the second direction Y.

Meanwhile, a diaphragm 50 is formed on the opposite surface side to the communication plate 15 of the flow channel-forming substrate 10, that is, the Z1 side in the third direction Z. In the embodiment, an elastic film 51 composed of silicon oxide provided on the flow channel-forming substrate 10 side and an insulating film 52 composed of zirconium oxide provided on the elastic film 51 are provided as the diaphragm 50. The liquid flow channel of the pressure generating chamber 12 or the like, is formed by anisotropic etching of the flow channel-forming substrate 10 from one surface side (surface side to which the nozzle plate 20 is bonded), and the Z1 side of the liquid flow channel of the pressure generating chamber 12 or the like is defined by the elastic film 51.

A piezoelectric actuator 300 having a first electrode 60, a piezoelectric layer 70, and a second electrode 80 is formed on the diaphragm 50 of the flow channel-forming substrate 10. In the embodiment, the piezoelectric actuator 300 is the driving element driven by the driving circuit 121 that is a semiconductor element, described in detail later. In the embodiment, the first electrode 60 is distributed for each pressure generating chamber 12, and configures an individual electrode that is independent for each active portion, described in detail later. The first electrode 60 is formed with a narrower width than the pressure generating chamber 12 in the second direction Y of the pressure generating chamber 12. That is, the end portion of the first electrode 60 is positioned inside a region facing the pressure generating chamber 12 in the first direction X of the pressure generating chamber 12. Both end portions of the first electrode 60 extend to the respective outer sides of the pressure generating chamber 12 in the second direction Y.

The piezoelectric layer 70 is continuously provided along the first direction X so as to have a predetermined width in the second direction Y. The width of the piezoelectric layer 70 in the second direction Y is wider than the length of the pressure generating chamber 12 in the second direction Y. Therefore, in the second direction Y of the pressure generating chamber 12, the piezoelectric layer 70 is provided up to the outer side of the pressure generating chamber 12.

In the second direction Y of the pressure generating chamber 12, the end portion of the supply path 19 side of the piezoelectric layer 70 is positioned further to the outside than the end portion of the first electrode 60. That is, the end portion of the first electrode 60 is covered by the piezoelectric layer 70. The end portion of the nozzle 21 side of the piezoelectric layer 70 is positioned further to the inside (pressure generating chamber 12 side) than the end portion of the first electrode 60, and the end portion of the nozzle 21 side of the first electrode 60 is not covered by the piezoelectric layer 70.

It is possible for the piezoelectric layer 70 to be composed of a piezoelectric material of an oxide having a polarized structure formed on the first electrode 60, and, for example, to be composed from a perovskite oxide represented by the general formula $ABO_3$, and it is possible to use a lead based piezoelectric material that includes lead, or a non-lead based piezoelectric material that does not include lead, or the like.

Concavities 71 corresponding to each dividing wall are formed in such a piezoelectric layer 70. The width of the concavities 71 in the first direction X is substantially the same as or wider than the width of each dividing wall in the first direction. In so doing, because rigidity of the portions (so-called arm portion of the diaphragm 50) facing the end portion of the pressure generating chamber 12 of the diaphragm 50 in the second direction Y is suppressed, it is possible for the piezoelectric actuator 300 to be satisfactorily displaced.

The second electrode 80 is provided on the opposite surface side to the first electrode 60 of the piezoelectric layer 70, and is configured as a common electrode shared by the active portions. The second electrode 80 may be provided on the inner surface of the concavity 71, that is, in the side surface of the concavity 71 of the piezoelectric layer 70, or may not be provided.

Such a piezoelectric element 300 configured by the first electrode 60, the piezoelectric layer 70, and the second electrode 80 generates displacement by applying a voltage between the first electrode 60 and the second electrode 80. That is, by applying a voltage between both electrodes, piezoelectric distortion occurs in the piezoelectric layer 70 interposed between the first electrode 60 and the second electrode 80. When a voltage is applied to both electrodes, the portion in which piezoelectric distortion of the piezoelectric layer 70 occurs is referred to as an active portion. In contrast, the portion of the piezoelectric layer 70 in which piezoelectric distortion does not occur is referred to as an inactive portion. The portion facing the pressure generating chamber 12 in the active portion in which piezoelectric distortion of the piezoelectric layer 70 occurs is referred to as a flexible portion, and the portion on the outer side of the pressure generating chamber 12 is referred to as an inflexible portion.

In the embodiment, all of the first electrode 60, the piezoelectric layer 70, and the second electrode 80 are continuously provided up to the outer side of the pressure generating chamber 12, in the second direction Y. That is, the active portion is continuously provided up to the outer side of the pressure generating chamber 12. Therefore, the portions facing the pressure generating chamber 12 of the piezoelectric actuator 300 from the active portions become the flexible portions, and the portions of the outer side of the pressure generating chamber 12 become the inflexible portions.

An individual wiring 91 that is an extraction wiring is extracted from the first electrode 60 of the piezoelectric actuator 300. In the embodiment, two rows of the active portions of the piezoelectric actuator 300 provided in parallel in the first direction X are provided in the second direction Y, and the individual wiring 91 is extracted between the active portions of the two rows of the piezoelectric actuators 300.

The common wiring 92 that is an extraction wiring is extracted from the second electrode 80. Each end portion of the individual wiring 91 extracted from the active portions of the two rows of the piezoelectric actuators 300 and the common wiring 92 are arranged so as to be on one straight line between the two rows of active portions on the flow channel-forming substrate 10, as shown in FIG. 4.

The common flexible cable 120 is connected to the end portion extending on the opposite side to the end portion connected to the piezoelectric actuator 300 of the individual wiring 91 and the common wiring 92. In the embodiment, one flexible cable 120 is provided for the active portions of two rows of piezoelectric actuators 300. Naturally, the number of flexible cables 120 is not limited thereto, and a flexible cable 120 may be provided for each row of active portions, or a flexible cable 120 divided in the second direction Y may be provided for each row of active portions. However, by providing one flexible cable 120 for the flow channel-forming substrate 10 as in the embodiment, it is possible to reduce the space for connecting the flexible cable 120, and to achieve size reductions in the head main body 1. It is possible to reduce the number of components to reduce costs by providing one flexible cable 120 for the flow channel-forming substrate 10.

The flexible cable 120 is a wiring substrate having flexibility, a so-called flexible print substrate, and in the embodiment, a driving circuit 121 that is a semiconductor element is mounted thereto. The flexible cable 120 is provided with an individual connection wiring 122 connected to the individual wiring 91, and a common connection wiring 123 connected to the common wiring 92, as shown in FIG. 6. The driving circuit 121 is connected to the other end portion on the opposite side to the one end portion connected to the individual wiring 91 of the individual connection wiring 122. An input wiring 124 in which one end is connected to the driving circuit 121 and extended until the opposite side to the individual connection wiring 122 is provided on the flexible cable 120. The input wiring 124 is for supplying head control signals such as setting signals that include a driving signal (COM), a clock signal (CLK), a latch signal (LAT), a change signal (CH), an image signal (SI) and a setting signal (SP) to the driving circuit 121. Inside the driving circuit 121, a switching element such as a transmission gate is provided for each piezoelectric actuator 300, the switching element is opened and closed based on the head control signals input by the input wiring 124, and the driving signal is supplied to the piezoelectric actuator 300 at a predetermined timing.

The common connection wiring 123 provided in the flexible cable 120 is continuously provided along the flexible cable 120 from the one end portion to the other end portion without being connected to the driving circuit 121, respectively. A voltage (bias voltage: vbs) is applied from the common connection wiring 123 to the second electrode 80 via the common wiring 92.

In the flexible cable 120, the individual wiring 91 and the individual connection wiring 122 are provided corresponding to the number of piezoelectric actuators 300 in the two rows. Accordingly, the pitch between the individual connection wirings 122 adjacent to one another becomes narrower according to changes in the density of the piezoelectric actuators 300.

The flexible cable 120, as shown in FIG. 6, forms the individual connection wiring 122 and common connection wiring 123 with a predetermined pattern such as a copper foil, and an input wiring 124 on the surface of a base film 125 formed with a resin material such as a polyimide, and the region other than the terminal to which the driving circuit 121, the individual wiring 91, the common wiring 92 and the like are connected is covered with an insulating material 126 such as a resist. A plating layer 127, such as silver plating or gold plating is formed on the terminal portion not covered by the insulating material 126 of the individual connection wiring 122, the common connection wiring 123 and the input wiring 124.

In the flexible cable 120, the solvent included in the solvent-based ink reacts with the sulfur included in the insulating material 126 such as the resist to generate sulfur as an out gas, the sulfur reacts with the silver or copper included in the individual connection wiring 122, the common connection wiring 123, and the input wiring 124 or the like, and becomes a corrosion product (sulfide) and attaches to the individual connection wiring 122, the common connection wiring 123, and the input wiring 124. The adjacent wirings short circuit each other by the sulfide attached to the wiring. In particular, because the individual connection wiring 122 is arranged at a high density according to the cost reductions and the size reductions in the flexible cable 120, the gap $w_1$ between adjacent individual connection wiring 122 is narrowed, short circuits due to individual connection wirings 122 adjacent to one each other easily occur. When the individual connection wiring 122 adjacent to each other short circuit, even in a case where only one of the plurality of piezoelectric actuators 300 connected to the shorted individual connection wiring 122 is driven, both are driven unintentionally driven at the same time. When the sulfides are generated on the wiring, the copper, silver or the like at the original location is lost, and a cavity is formed, thereby causing a disconnection. In particular, because the connection wiring 122 arranged with a high density are formed with a narrow width, disconnections easily occur due to sulfides being generated, and piezoelectric actuator 300 driving, that is, ink ejection defects occur.

The outgas is not limited to being due to the insulating material 126, such as a resist, and in a case of using butyl rubber having resistance to the solvent-based ink in components of the recording head, for example, a wiping blade that wipes the liquid ejecting surface or a tube that supplies or discharges the ink, sulfur added to the butyl rubber by the vulcanization process is generated as the outgas.

Therefore, in the embodiment, although described in detail later, by providing the dummy wiring that absorbs sulfur on the circuit substrate 600 connected to the flexible cable 120 or the external wiring connection substrate 740 connected to the circuit substrate 600 via the connection wiring 610, the sulfur is absorbed by the dummy wiring, and it is possible to suppress the generation of sulfides due to the sulfur in the individual connection wiring 122, the common connection wiring 123, and the input wiring 124, or the like.

As shown in FIG. 5, a protective substrate 30 having approximately the same size as the flow channel-forming substrate 10 is bonded to the surface of the piezoelectric actuator 300 side of the flow channel-forming substrate 10. The protective substrate 30 includes a holding portion 31 that is a space for protecting the piezoelectric actuator 300. Two holding portions 31 are formed lined up in the second direction Y between the rows of piezoelectric actuators 300 arranged in parallel in the first direction X. A first through hole 32 that penetrates in the third direction Z between the two holding portions 31 arranged in parallel in the second direction Y is provided in the protective substrate 30. The end portions of the individual wiring 91 and the common wiring 92 extracted from the electrode of the piezoelectric actuator 300 are provided extending so as to be exposed in the first through hole 32, and the individual wiring 91 and the common wiring 92 and the individual connection wiring 122 and the common connection wiring 123 of the flexible cable 120 are electrically connected in the first through hole 32. The method of connecting the individual wiring 91 and the common wiring 92, and the individual connection wiring 122 and the common connection wiring 123 of the flexible cable 120 is not particularly limited, and examples thereof include soldering and brazing methods, eutectic bonding, soldering, a conductive adhesive (ACP, ACF) including conductive particles, and a non-conductive adhesive (NCP, NCF). In the embodiment, as shown in FIG. 6, the individual connection wiring 122 and the common connection wiring 123 of the flexible cable 120, and the individual wiring 91 and the common wiring 92 are connected by the non-conductive adhesive 130. In the embodiment, inside the first through hole 32 is filled with the filler 131 such as a bonding agent. Even if the sulfides formed on the dummy wiring, described in detail later, drops into the first through hole 32, it is possible to prevent short circuiting or disconnection of the individual wiring 91, the individual connection wiring 122, the common wiring 92, and the common connection wiring 123 due to the sulfides with the filler 131. Naturally, the filler 131 may not be provided.

As shown in FIG. 5, the case member 40 defined by both the manifold 100 that communicates with the plurality of pressure generating chambers 12, and the flow channel-forming substrate 10 is fixed on the protective substrate 30. The case member 40 has substantially the same shape as the above-described communication plate 15 seen in plan view, and is bonded to the protective substrate 30 and also bonded to the above-described communication plate 15. Specifically, the case member 40 has a concavity 41 with a depth in which the flow channel-forming substrate 10 and the protective substrate 30 are accommodated on the protective substrate 30 side. The concavity 41 has a wider opening area than the surface bonded to the flow channel-forming substrate 10 of the protective substrate 30. The opening surface on the nozzle plate 20 side of the concavity 41 is sealed by the communication plate 15 in a state in which the flow channel-forming substrate 10 and the like is accommodated in the concavity 41. In so doing, a third manifold portion 42 is defined by the case member 40 member, and the flow channel-forming substrate 10 on the outer peripheral portion of the flow channel-forming substrate 10. The manifold 100 of the embodiment is configured by the first and second manifold portions 17 and 18 provided on the communication plate 15 and the third manifold portion 42 defined by the case member 40 and the flow channel-forming substrate 10. The manifold 100 is continuously provided along the first direction X that is the arrangement direction of the pressure generating chambers 12, and the supply path 19 that communicates with each pressure generating chamber 12 and the manifold 100 is arranged in the first direction X.

A compliance substrate 45 is provided on the surface in which the first manifold portion 17 and the second manifold portion 18 of the communication plate 15 open. The compliance substrate 45 seals the opening on the liquid ejecting surface 20*a* side of the first manifold portion 17 and the second manifold portion 18. The compliance substrate 45, in the embodiment, is equipped with a sealing film 46 formed from a thin film having flexibility, and a fixed substrate 47 composed of a hard material such as a metal. Because the region facing the manifold 100 of the fixed substrate 47 forms an opening portion 48 that is completely removed in the thickness direction, one surface of the manifold 100 is a compliance portion 49 that is a flexible portion sealed only by the sealing film 46 having flexibility.

An introduction path 44 for supplying ink to each manifold 100 while communicating with the manifold 100 is provided in the case member 40. A second through hole 43 communicating with the first through hole 32 of the protective substrate 30 and into which the flexible cable 120 is inserted is provided in the case member 40.

In the head main body 1, when ink is ejected, ink is removed from the introduction path 44, and the interior of the flow channel is filled with ink from the manifold 100 to the nozzle 21. Thereafter, by applying a voltage to each piezoelectric actuator 300 corresponding to the pressure generating chamber 12 according to signals from the driving circuit 121, the diaphragm 50 is flexurally deformed along with the piezoelectric actuator 300. In so doing, the pressure in the pressure generating chamber 12 increases, and ink droplets are ejected from a predetermined nozzle 21.

In the head main body 1, the flexible cable 120 is provided protruding to the opposite side to the liquid ejecting surface 20*a* in which the nozzles 21 open.

As shown in FIGS. 1 and 2, the recording head I of the embodiment is further equipped with a supply channel forming member 500 provided on the flexible cable 120 side of the head main body 1, a circuit substrate 600 provided on the opposite side of the supply channel forming member 500 to the head main body 1, and a fixed member 700 provided on the opposite side of the supply channel forming member 500 to the head main body 1. In the embodiment, each direction in the recording head I will be described based on the first direction X, the second direction Y, and the third direction Z of the head main body 1 mounted to the recording head I.

Figure 8A:
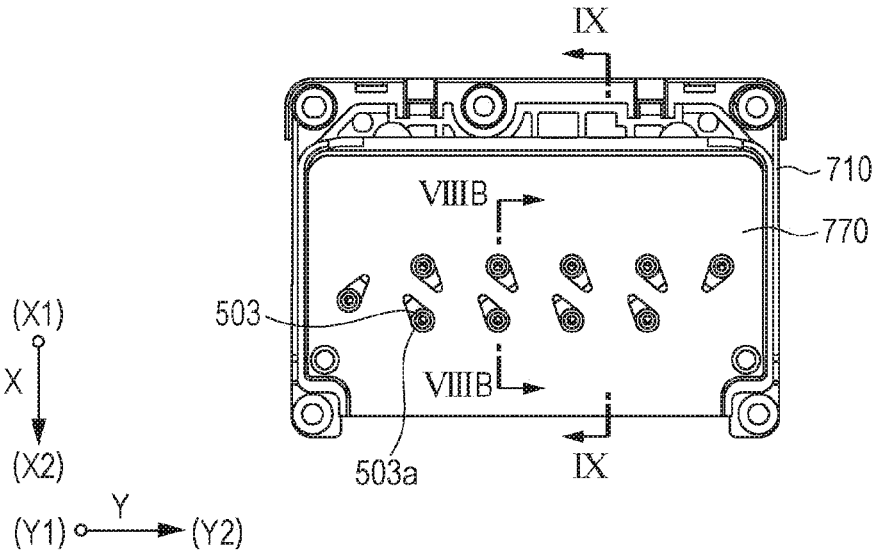
FIGS. 8A and 8B are a plan view and a cross-sectional view of the main portions of the recording head according to Embodiment 1 of the invention.
Figure 8B:
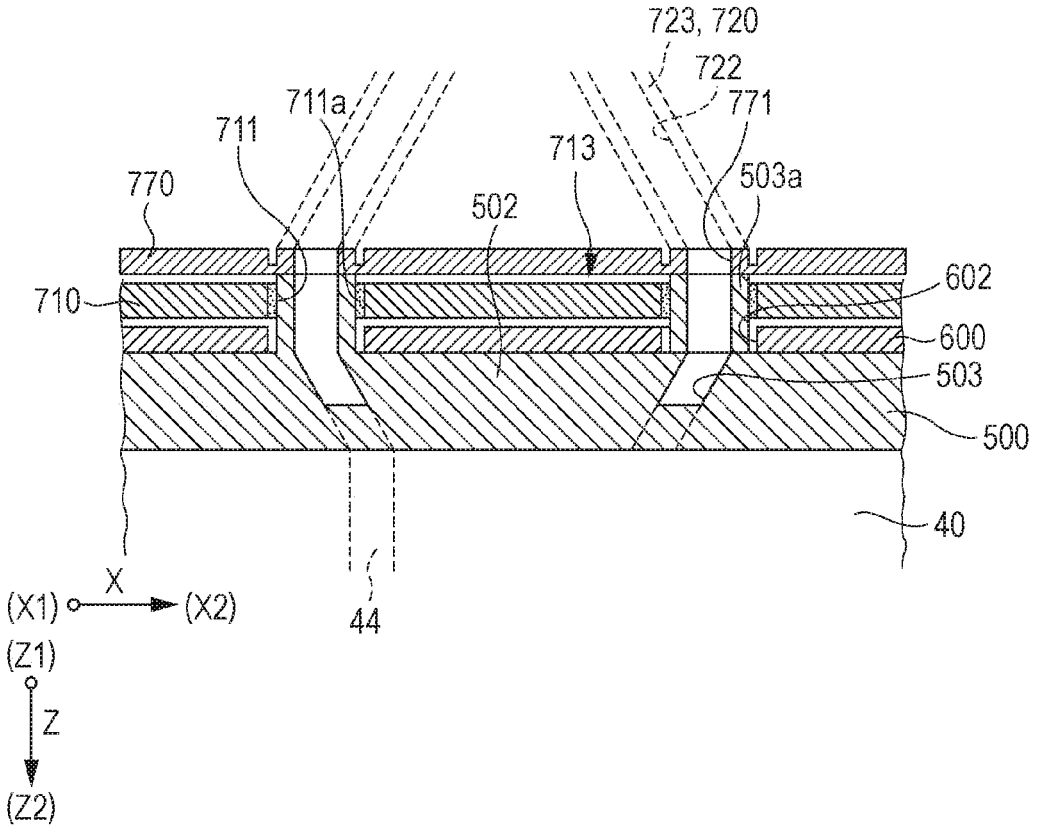
Figure 9:
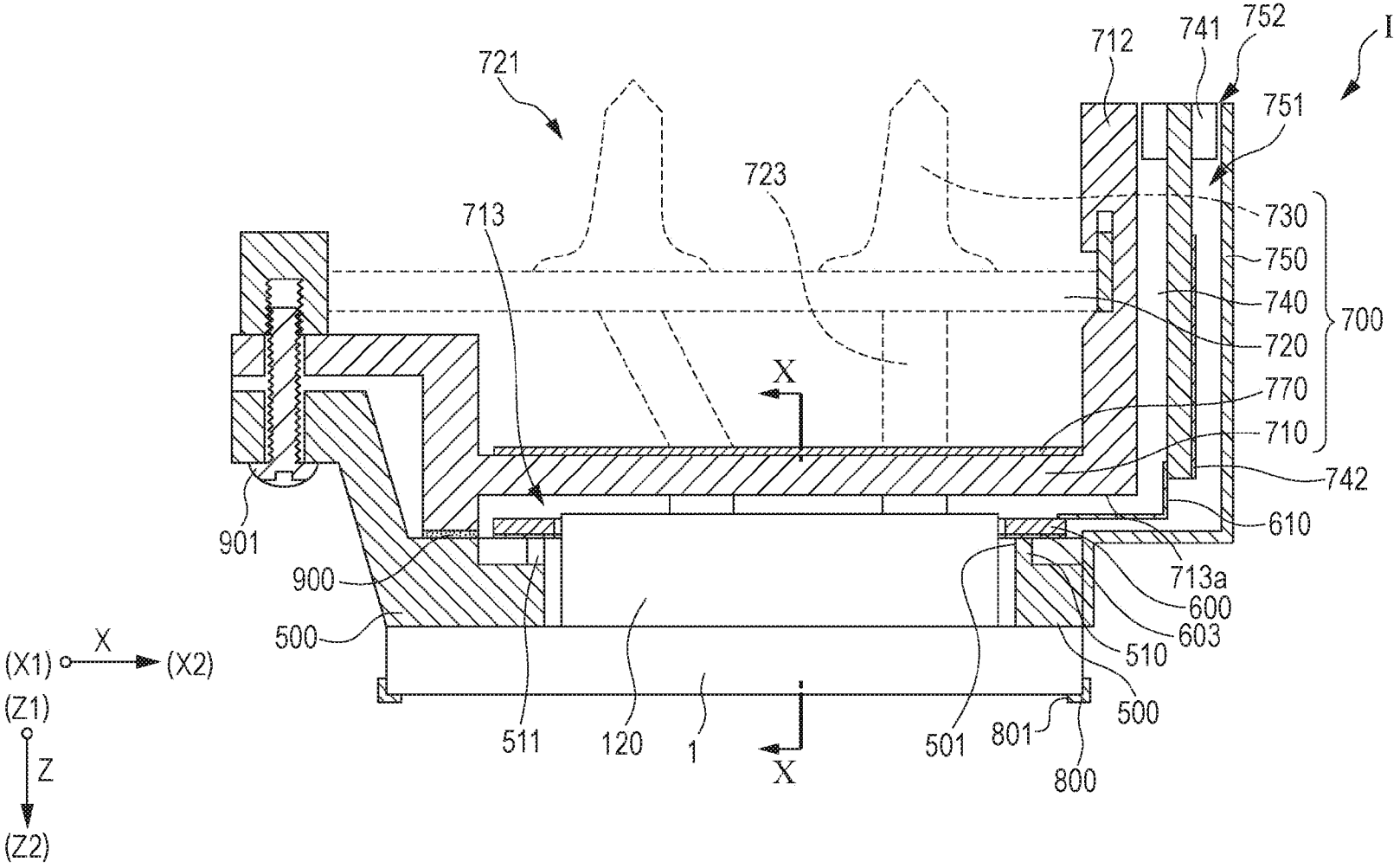
FIG. 9 is a cross-sectional view of the main portions of the recording head according to Embodiment 1 of the invention.
Figure 10:
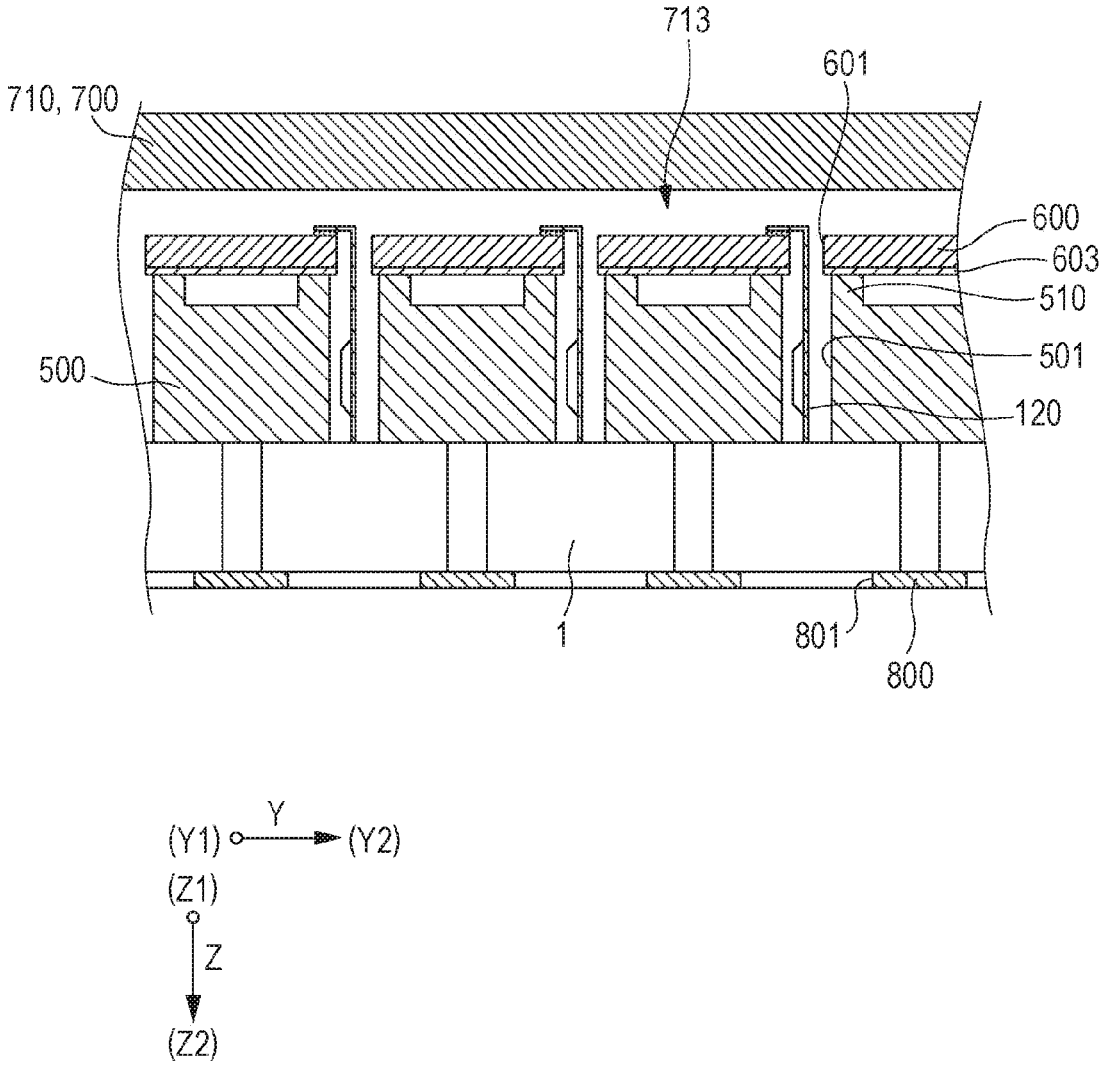
FIG. 10 is a cross-sectional view of the main portions of the recording head according to Embodiment 1 of the invention.

The supply channel forming member 500 will be described with reference to FIGS. 8A to 10. FIGS. 8A and 8B are plan view of the main portions of the recording head and a drawing schematically showing a cross-section thereof taken along line VIIIA-VIIIA, FIG. 9 is a drawing schematically showing a cross-section taken along line IX-IX in FIG. 8A, and FIG. 10 is a drawing schematically showing a cross-section of the main portions thereof taken along line X-X in FIG. 9.

As shown in FIGS. 1 and 2, the supply channel forming member 500 of the embodiment includes a plurality, in the embodiment, five, of head main bodies 1 fixed to the bottom surface thereof in the arrangement direction, that is, the second direction Y, of the nozzle rows of the head main bodies 1.

As shown in FIG. 1, the third through hole 501 defined by the dividing wall 502 and penetrating in the thickness direction of the supply channel forming member 500 is formed in the supply channel forming member 500. The flexible cable 120 of each head main body 1 is inserted in the third through hole 501, and each of the head main bodies 1 is fixed to the outer edge portion of each third through hole 501.

As shown in FIG. 8B, the supply flow channel 503 that supplies ink while communicating with the introduction path 44 provided in the case member 40 of the head main body 1 is provided in the dividing wall 502 that defines the third through hole 501 (refer to FIG. 1). The supply flow channel 503 is provided penetrating in the thickness direction so as to open in the head main body 1 side of the supply channel forming member 500 and to open in the fixed member 700 side. A plurality, for example, two, of supply flow channels 503 are provided with respect to one dividing wall 502. The opening in the circuit substrate 600 side of the supply flow channel 503 is provided so as to become the end surface of a protruding protrusion 503*a*. By the protrusion 503*a* being inserted in the insertion hole 602 of the circuit substrate 600, described in detail later, the supply flow channel 503 that opens in the end surface of the protrusion 503*a* and the introduction hole 722 of the fixed member 700, described later, are communicated.

As shown in FIGS. 9 and 10, in the surface on the opposite side to the head main body 1 of the case member 40, a rib 510 that is contiguous along the opening edge portion of the third through hole 501 is provided on the surface in which the third through hole 501 opens. That is, the rib 510 is provided along the opening edge portion of the connection hole 601 that is a through port of the circuit substrate 600, and protruding to the Z1 side that is the circuit substrate 600 side, and the circuit substrate 600 is mounted on the end surface of the Z1 side of the rib 510. That is, the rib 510 supports the circuit substrate 600. A notch 511 that opens in the side surface is provided in the rib 510. Here, although described in detail later, because the first accommodation space in which the circuit substrate 600 and the external wiring connection substrate 740 are accommodated includes the exit port that communicates with the outside in the X2 side in the first direction X, it is preferable that the notch 511 is provided on the distant side to X2, that is on the X1 side opposite to X2.

The flexible cable 120 is accommodated in the first through hole 32 of the head main body 1, the second through hole 43 and the third through hole 501 of the supply channel forming member 500. Accordingly, the second accommodation space that accommodates the flexible cable 120 of the embodiment is configured by the first through hole 32, the second through hole 43, and the third through hole 501.

As shown in FIGS. 1 and 2, a cover head 800 that is shared by the plurality of head main bodies 1 is provided on the ink discharge surface in which the nozzles 21 of the head main body 1 fixed to the supply channel forming member 500 open. The cover head 800 is provided with a window portion 801 that exposes the nozzles 21 of each head main body 1, and ink droplets are discharged from the nozzles 21 exposed via the window portion 801.

As shown in FIGS. 1 and 2, the circuit substrate 600 is held on the opposite side to the head main body 1 of the supply channel forming member 500.

The circuit substrate 600 is a substrate to which various wirings or electronic components are mounted, and is formed from a rigid substrate in the embodiment. A connection hole 601 that is a through port penetrating in the third direction Z is provided in the circuit substrate 600. The tip portion of the flexible cable 120 that is a driving line of the head main body 1 inserted in the connection hole 601 is bent to be electrically connected to the circuit substrate 600. That is, the flexible cable 120 is inserted from the surface of the head main body 1 to the connection hole 601 of the circuit substrate 600, and the tip of the flexible cable 120 is bent along the surface of the circuit substrate 600 on the opposite side to the head main body 1 of the circuit substrate 600 to be connected to the circuit substrate 600. In the embodiment, because the five head main bodies 1 and the flexible cable 120 are provided in the recording head I, five connection holes 601 are provided in parallel in the second direction Y in the circuit substrate 600. That is, in the embodiment, the flexible cable 120 of the plurality of head main bodies 1 is shared and connected to one circuit substrate 600. Thereby, it is possible to reduce costs by reducing the number of components.

As shown in FIG. 8B, the insertion hole 602 into which the protrusion 503*a* of the supply channel forming member 500 is inserted, as described above, is provided in the circuit substrate 600. By the protrusion 503*a* of the supply channel forming member 500 being inserted in the insertion hole 602, the supply flow channel 503 provided in the protrusion 503*a* opens to the outside (opposite side to the supply channel forming member 500) of the circuit substrate 600, and is connected to the introduction hole 722 of the fixed member 700, described later.

The circuit substrate 600 is accommodated on a circuit substrate holding portion 713 that is a space provided between the supply channel forming member 500 and the fixed member 700. That is, the circuit substrate 600 is accommodated while separated from the dividing wall of the circuit substrate holding portion 713 by the rib 510.

As shown in FIG. 9, the circuit substrate 600 is electrically connected to the external wiring connection substrate 740 fixed to the side surface of the fixed member 700. The external wiring (not shown) to which head control signals or the like for driving the piezoelectric actuator 300 are input is electrically connected to the external wiring connection substrate 740, and the head control signals and the like from are supplied from the external wiring to the flexible cable 120 of the head main body 1 via the external wiring connection substrate 740 and the circuit substrate 600. The circuit substrate 600 and the external wiring connection substrate 740 are connected via a wiring substrate having flexibility, that is, the connection wiring 610 that is the flexible cable. It is possible for the connection wiring 610 to be bent by connecting the circuit substrate 600 and the external wiring connection substrate 740 by the connection wiring 610 having flexibility, and it is possible to arrange the connection wiring 610 in a direction in which the surface direction of the circuit substrate 600 and the surface direction of the external wiring connection substrate 740 intersect one another. That is, it is possible to arrange the circuit substrate 600 so that the surface direction is the direction along the first direction X, and arrange the external wiring connection substrate 740 so that the surface direction is the direction along the third direction Z.

As shown in FIGS. 1 and 9, the fixed member 700 is equipped with a base member 710 fixed to the surface (surface to which the circuit substrate 600 is fixed) on the opposite side to the head main body 1 of the supply channel forming member 500, a supply needle holder 720 in which a plurality of supply needles 730 is arranged, the external wiring connection substrate 740 fixed to one side surface of the base member 710, and a protective member 750 that covers the external wiring connection substrate 740.

The surface of the Z2 side of the base member 710 is fixed to the circuit substrate 600 side of the supply channel forming member 500, the circuit substrate holding portion 713 is formed between the base member 710 and the supply channel forming member 500, and the circuit substrate 600 is held in the circuit substrate holding portion 713.

As shown in FIG. 8B, the insertion communication hole 711 into which the protrusion 503*a* of the supply channel forming member 500 is inserted is provided in the base member 710. By the protrusion 503*a* of the supply channel forming member 500 being inserted in the insertion hole 602 provided in the circuit substrate 600 and insertion communication hole 711 provided in the base member 710, the supply flow channel 503 provided in the end surface thereof is exposed in the supply needle holder 720 side. The insertion communication hole 711 of the base member 710 and the protrusion 503*a* are sealed by the adhesive 711*a*, and the infiltration of ink from between the insertion communication hole 711 and the protrusion 503*a* to the circuit substrate 600 is suppressed.

As shown in FIG. 9, the circuit substrate 600 is accommodated on a circuit substrate holding portion 713 that is a space provided between the supply channel forming member 500 and the base member 710.

The circuit substrate holding portion 713 is connected by the adhesive 900 in the region on the side at which the connection wiring 610 is connected to the circuit substrate 600, that is, the region other than the protective member 750 side. The protective member 750 described in detail below covers the opening of the circuit substrate holding portion 713 not adhered by the adhesive 900, and blocks the circuit substrate holding portion 713. That is, in the embodiment, the circuit substrate holding portion 713 includes a connection wiring insertion hole 713*a* opening in the protective member 750 side and in which the connection wiring 610 is inserted.

The supply channel forming member 500 and the fixed member 700 are fixed by a screw member 901. In the embodiment, the supply channel forming member 500 and the fixed member 700 are fixed by the screw member 901 at four locations that are the corner portions when seen in plan view from the third direction Z.

As shown in FIGS. 1 and 9, the supply needle holder 720 is fixed to the opposite side to the head main body 1 of the base member 710.

The supply needle holder 720 is fixed to the opposite side to the supply channel forming member 500 of the base member 710 via the seal member 770 composed of a rubber or the like and includes a cartridge mounting portion 721 to which an ink cartridge that is a storage unit in which ink is stored is mounted on the Z1 side.

As shown in FIGS. 2 and 8B, the pipe-like supply communication path forming portion 723 in which a plurality of introduction holes 722 for which one end opens in the cartridge mounting portion 721 and the other end opens in the base member 710 side are each formed is provided protruding in the bottom surface of the supply needle holder 720. The introduction hole 722 is connected to the supply flow channel 503 via the supply communication path 771 provided in seal member 770.

A plurality of supply needles 730 to which the liquid storage unit, such as an ink cartridge or an ink tank, is connected directly or via a supply pipe, such as a tube, is fixed to the opening part of the introduction hole 722 on the Z1 side of the supply needle holder 720 via a filter 731 (refer to FIG. 2) for removing air bubbles or foreign materials in the ink.

Each of these supply needles 730 includes a through path (not shown) that communicates with the introduction hole 722 in the interior thereof. By the liquid storage unit being connected directly or via a supply pipe to the supply needle 730, the ink in the liquid supply unit is supplied to the introduction hole 722 of the supply needle holder 720 via the communication path of the supply needle 730. The ink introduced to the introduction hole 722 is supplied to the supply flow channel 503 via the supply communication path 771 provided in the seal member 770, and introduced to the introduction path 44 of the head main body 1 via the supply flow channel 503.

A holding wall portion 712 is provided extending in the Z1 direction on the X1 side of the base member 710. A protective member 750 is provided further to the X1 side of the holding wall portion 712. The external wiring connection substrate holding portion 751 that is a space that holds the external wiring connection substrate 740 is formed between the holding wall portion 712 and the protective member 750, and the external wiring connection substrate 740 is accommodated in the external wiring connection substrate holding portion 751 so that the third direction Z becomes the surface direction.

The external wiring connection substrate 740 is connected to the above-described circuit substrate 600 via the connection wiring 610. A plurality of connectors 741 is provided on the external wiring connection substrate 740 on the opposite side to the end portion connected to the circuit substrate 600, that is, both surfaces on the Z1 side, and the external wiring from the control device is connected to the connector 741.

The protective member 750 has a box-like shape the X1 and Z1 surfaces provided outside the holding wall portion 712 are open, as shown in FIG. 9, and the external wiring connection substrate holding portion 751 in which only Z1 is opened is formed by the opening on the X1 side being blocked by the holding wall portion 712. That is, the external wiring connection substrate holding portion 751 is provided as an exit port 752 that communicates the Z1 side of the external wiring connection substrate 740 with the outside, and the external wiring is inserted from the exit port 752 to be connected to the connector 741. Although the exit port 752 is also able to be blocked by the seal member or the like when the external wiring is inserted, in the embodiment, the exit port 752 in which the external wiring is inserted is opened without being blocked. That is the external wiring connection substrate holding portion 751 is opened to the atmosphere via the exit port 752.

In this way, the external wiring connection substrate holding portion 751 that holds the external wiring connection substrate 740 and the circuit substrate holding portion 713 of the circuit substrate 600 are communicated by the connection wiring insertion hole 713*a* as described above. That is, the first accommodation space that accommodates the external wiring connection substrate 740 and circuit substrate 600 that are rigid substrates is configured by the external wiring connection substrate holding portion 751 and the circuit substrate holding portion 713 in the embodiment. That is, the flexible cable 120, the circuit substrate 600, and the external wiring connection substrate are accommodated in the accommodation space, and the accommodation space is equipped with the first accommodation space configured by the external wiring connection substrate holding portion 751 that accommodates the external wiring connection substrate 740 and the circuit substrate 600 and the circuit substrate holding portion 713, and the second accommodation space configured by the first through hole 32, the second through hole 43, and third through hole 501 that accommodate the flexible cable 120.

In this way, by opening the external wiring connection substrate holding portion 751 that is the first accommodation space to the atmosphere with the exit port 752, even if components included in the ink, and, in particular, the solvent included in a solvent-based ink infiltrates, as a gas, into the circuit substrate holding portion 713 and the external wiring connection substrate holding portion 751 that are the first accommodation space from the connection part of the flow channel provided in each member, it is possible to discharge the gas from the exit port 752 to the outside. Because the circuit substrate holding portion 713 of the first accommodation space and the third through hole 501 of the second accommodation space are communicated by the notch 511, it is possible to discharge the gas infiltrating into the second accommodation space to the outside by the external wiring connection substrate holding portion 751 that is the first accommodation space to the atmosphere with the exit port 752.

By suctioning the gas in the external wiring connection substrate holding portion 751 from the exit port 752 with an suction unit, such as a suction pump, it is possible to verify the sealed state of the connection part of the flow channel provided in each member. Specifically, the pressure in the accommodation space including the external wiring connection substrate holding portion 751 is reduced by suctioning from the exit port 752 by the suction unit, it is possible to detect whether or not the pressure in the flow channel is reduced. In a case where the lowered pressure is detected in the flow channel, it is possible for the flow channel to communicate with accommodation space including the external wiring connection substrate holding portion, and to determine whether the sealing in the connection parts of paired flow channels is insufficient. If low pressure in the flow channel is not detected, it is possible to determine that the sealing in the connection part between paired flow channels is reliably performed. Accordingly, it is preferable that the exit port 752 is opened to the atmosphere.

In this way, it is possible to prevent breakdowns due to materials from the outside hitting the circuit substrate 600 or the external wiring connection substrate 740 or defects such as short circuits or disconnection while ink ore foreign materials such as dust attach thereto by holding the circuit substrate 600 and the external wiring connection substrate 740 in the first accommodation space that is the internal space of the recording head I. It is possible suppress the infiltration of ink to the inside by sealing, with the adhesive 900, the circuit substrate holding portion 713 that is the space in which the circuit substrate 600 and the flexible cable 120 are connected excluding a partial region on the periphery of the connector 741 present on the Z1 side. Naturally, because the liquid ejecting surface 20*a* of the recording head I becomes the surface on the Z2 side, that is, the surface on the opposite side to the connector 741 of the external wiring connection substrate 740, ink does not easily enter the inside even if the connector 741 side is opened by the exit port 752.

Figure 11A:
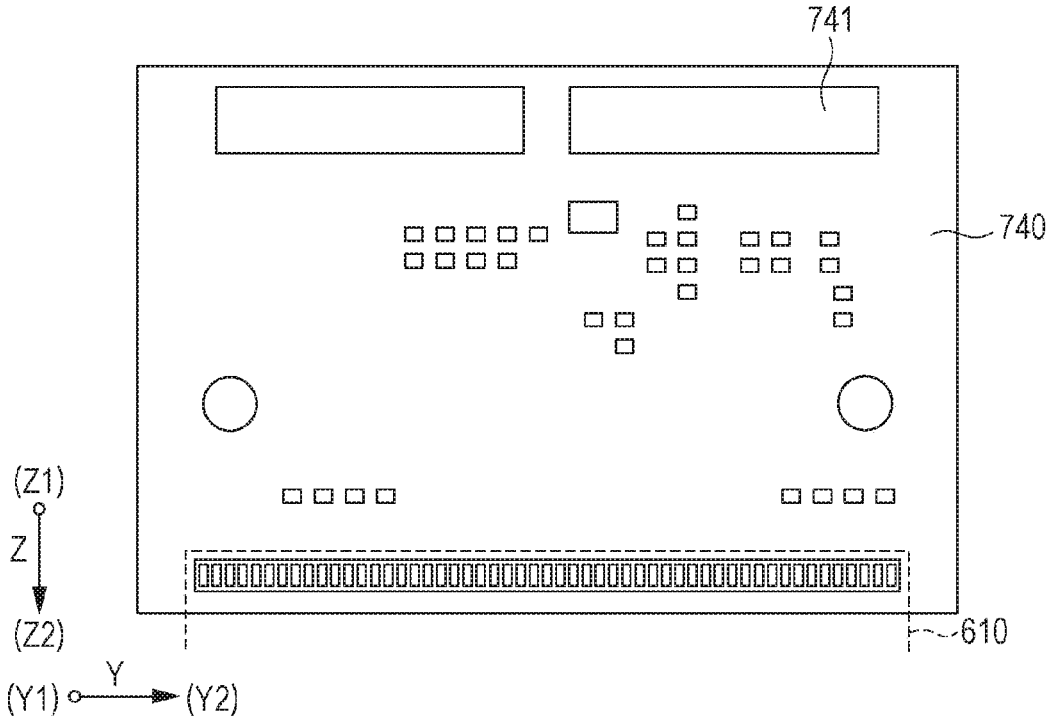
FIGS. 11A and 11B are plan views of an external wiring substrate according to Embodiment 1 of the invention.
Figure 11B:
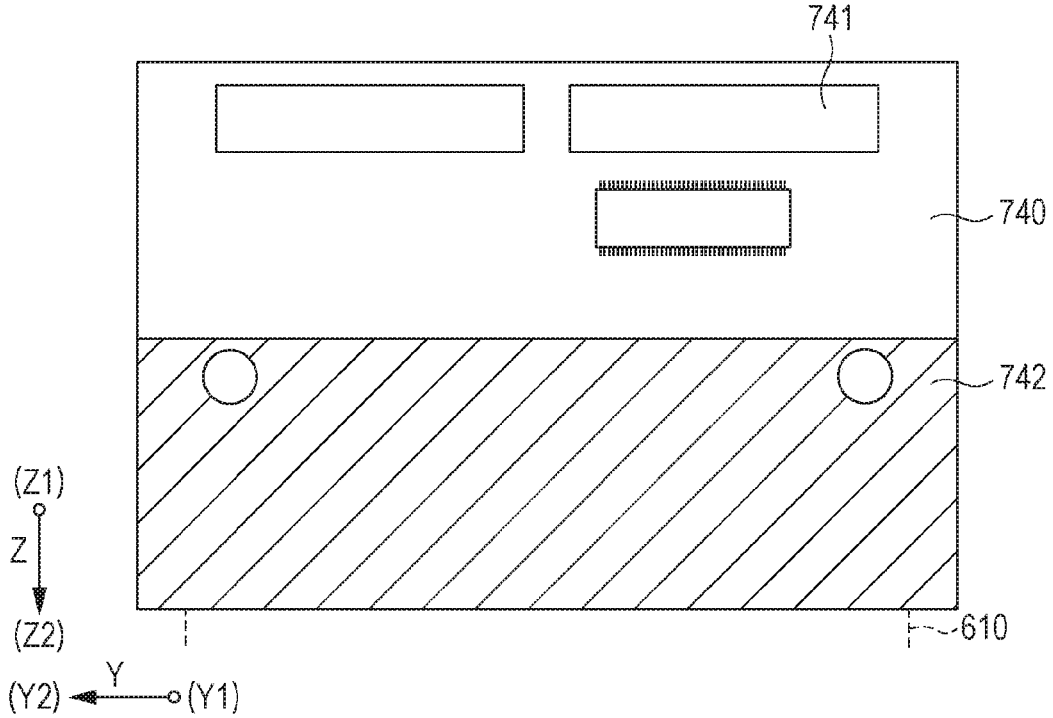

In the embodiment, the first dummy wiring 742 that adsorbs the sulfur is provided, as shown in FIG. 11, on the external wiring connection substrate 740. Specifically, a wiring (not shown) that transmits print signals and the like to the circuit substrate 600 is provided on the external wiring connection substrate 740, and the first dummy wiring 742 is provided on a region on which the wiring is not provided. In the embodiment, as shown in FIG. 9, because the connection wiring 610 that connects the external wiring connection substrate 740 and the circuit substrate 600 is connected to the holding wall portion 712 side of the external wiring connection substrate 740, the wiring is provided on the surface on the X1 side of the holding wall portion 712 side, and the first dummy wiring 742 is provided on the opposite side to the surface to which the connection wiring 610 of the external wiring connection substrate 740 is connected, that is, the X2 side that is the protective member 750 side. The first dummy wiring 742 is provided further to the Z2 side that is the head main body 1 side than the connector 741, as shown in FIG. 11B. Naturally, in a case of using a rigid substrate on which the wiring is provided on the inside in the thickness direction as the external wiring connection substrate 740, the first dummy wiring 742 can also be provided on the surface on the X1 side.

Examples of the first dummy wiring 742 include materials that adsorb sulfur, for example, copper (Cu), silver (Ag) and the like. Generally, because low cost copper (Cu) is frequently used in the wiring of the rigid substrate, and it is possible to reduce costs by also using the same copper (Cu) as the wiring as the dummy wiring. In a case of using silver (Ag), it is possible for sulfur to be more efficiently adsorbed than with copper (Cu), and further concavities and convexities may be formed in the surface of the first dummy wiring 742, and it is possible to thereby widen the surface area of the first dummy wiring 742, and make the first dummy wiring 742 easily adsorb the sulfur.

It is possible for sulfur to be actively adsorbed on the first dummy wiring 742 by providing the first dummy wiring 742. Therefore, it is possible for the sulfur to be adsorbed and reacted on the wiring provided on the external wiring connection substrate 740, and to suppress the attachment of sulfide to the wiring. Accordingly, it is possible to suppress short circuiting and disconnection of the wirings formed on the external wiring connection substrate 740. Because the circuit substrate holding portion 713, the first through hole 32, the second through hole 43, and the third through hole 501 communicate in the external wiring connection substrate holding portion 751, it is also possible for in the circuit substrate holding portion 713, the first through hole 32, the second through hole 43, and the third through hole 501 to be adsorbed on the first dummy wiring 742 by the first dummy wiring 742.

Naturally, as described above, a case where the solvent-based ink and the solvent gas included in the solvent-based ink infiltrates from the exit port 752 and the sulfur is generated as an outgas from the insulating material 126, such as a resist, in which the solvent is provided on the flexible cable 120 or the like, and a case where sulfur added to the butyl rubber is generated as an outgas by reacting with the solvent of the solvent-based ink and infiltrates from the exit port 752 are considered. There are also cases where the solvent gas included in the solvent-based ink infiltrates into the accommodation space from the connection parts or the like of the flow channel other than exit port 752. Since the external wiring connection substrate 740 is accommodated at the closest location to the exit port 752 by providing the first dummy wiring 742 on the external wiring connection substrate 740, it is possible to particularly effectively absorb sulfur infiltrating from the exit port 752.

Figure 12A:
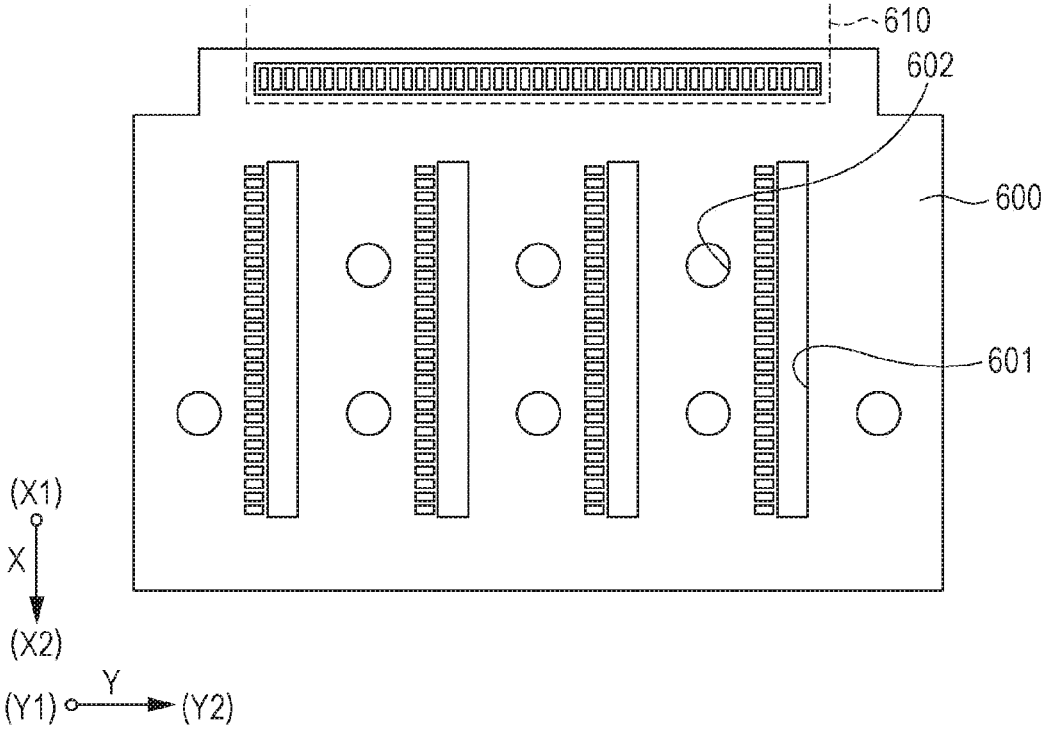
FIGS. 12A and 12B are plan views of a circuit substrate according to Embodiment 1 of the invention.
Figure 12B:
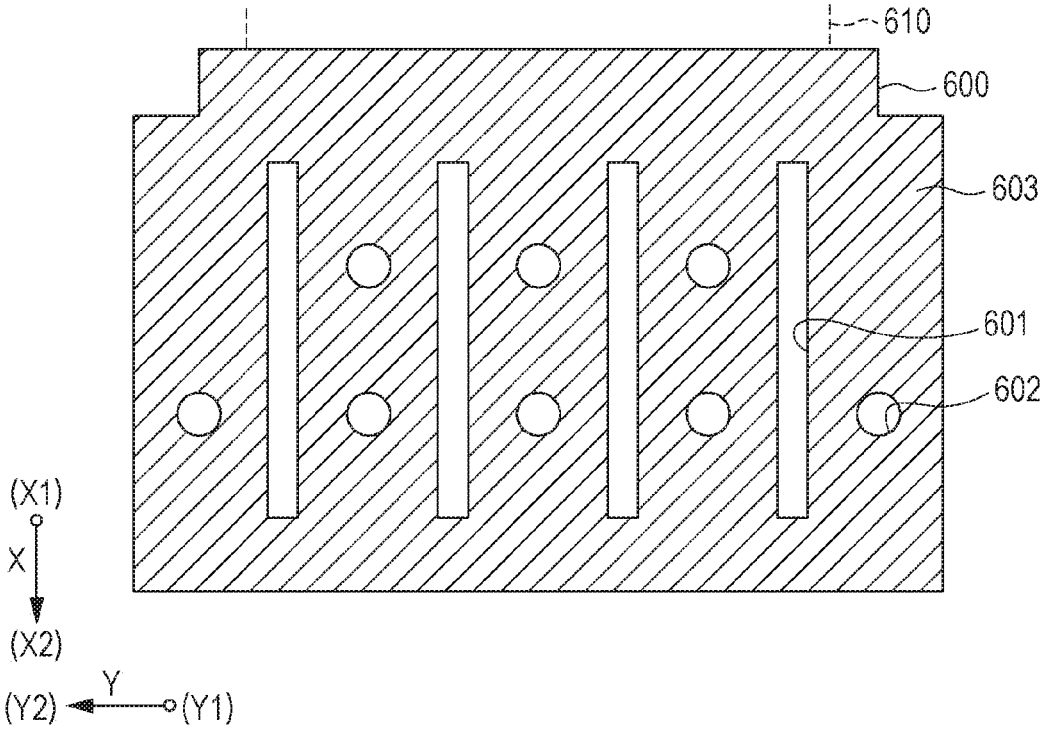

Meanwhile, as shown in FIG. 12, the second dummy wiring 603 formed from a material that adsorbs sulfur, for example, copper (Cu) or silver (Ag) is provided on the circuit substrate 600 similarly to the first dummy wiring 742 of the external wiring connection substrate 740. The second dummy wiring 603 is provided on a region on which the wiring by which the head control signals and the like are supplied, electronic components or the like (not shown) are not provided. In the embodiment, as shown in FIG. 12B, the second dummy wiring 603 is provided on the surface of the Z2 side that is the opposite side to the surface of the Z1 side to which the flexible cable 120 of the circuit substrate 600 is connected. That is, the second dummy wiring 603 is provided on the surface on the rib 510 side, as shown in FIG. 9. The second dummy wiring is provided across the entire surface on the Z2 side of the circuit substrate 600.

By providing the second dummy wiring 603 on the circuit substrate 600 in this way, it is possible for the sulfur in the circuit substrate holding portion 713 to be actively adsorbed on the second dummy wiring 603 and for the generation of sulfides by adsorbing sulfur on the circuit substrate 600 to be suppressed. By providing the second dummy wiring 603 on the circuit substrate 600, it is possible for sulfur in the first through hole 32, the second through hole 43, and the third through hole 501 that are the second accommodation space that communicates with the circuit substrate holding portion 713 to be adsorbed by the second dummy wiring 603. That is, in a case where the second dummy wiring 603 is not provided on the circuit substrate 600, although sulfur in the first through hole 32, the second through hole 43, and the third through hole 501 that are the second accommodation space should be adsorbed by the first dummy wiring 742 of the external wiring connection substrate 740, because the circuit substrate holding portion 713 is present between the third through hole 501 and the external wiring connection substrate holding portion 751, there is concern of the sulfur being adsorbed on the wiring of the flexible cable 120 without being efficiently adsorbed. In the embodiment, by providing the second dummy wiring 603 on the circuit substrate 600 accommodated in the circuit substrate holding portion 713 that directly communicates with the third through hole 501, it is possible for the sulfur in the third through hole 501 to be efficiently adsorbed by the second dummy wiring 603 and possible for the adsorption amount of the sulfur to the wiring of the flexible cable 120 to be reduced.

Figure 13:
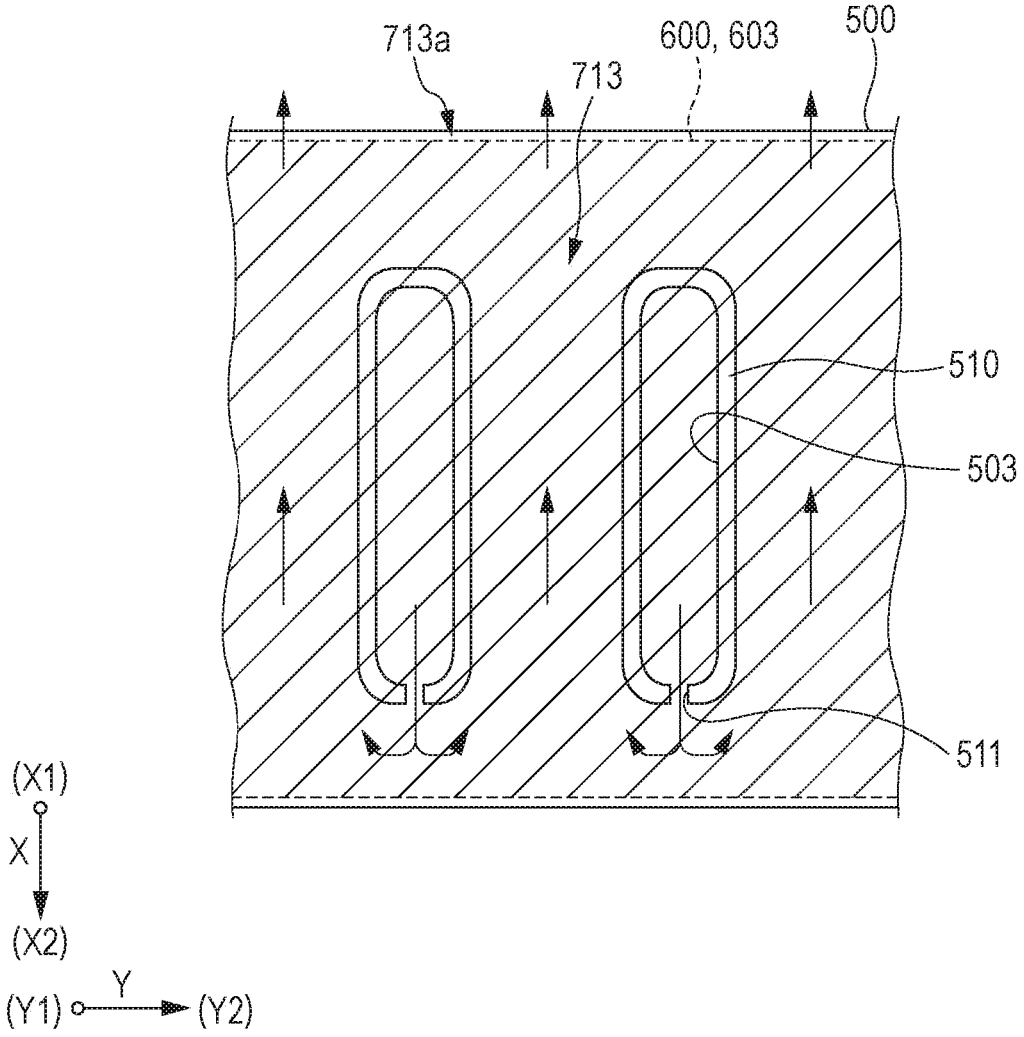
FIG. 13 is a plan view of the main portions of the recording head according to Embodiment 1 of the invention.

The rib 510 is provided on the supply channel forming member 500, and the surface on the Z2 side on which the second dummy wiring 603 of the circuit substrate 600 is supported by the rib 510 is separated from the wall surface on the Z2 side of the circuit substrate holding portion 713. In so doing, it is possible to thereby widen the surface area of the second dummy wiring 603, and make the second dummy wiring 603 easily adsorb the sulfur. Naturally, the reason is that, when the second dummy wiring 603 is adhered to the surface on the Z2 side of the circuit substrate holding portion 713, the area at which the second dummy wiring 603 comes in contact with the sulfur is reduced, and the adsorption amount of the sulfur is reduced. The notch 511 that opens in the X2 side distant from the X1 side that communicates with the external wiring connection substrate holding portion 751 is provided on the rib 510. Accordingly, as shown in FIG. 13, the sulfur in the third through hole 501 flows in the circuit substrate holding portion 713 from the X2 side via the notch 511, and flows to the connection wiring insertion hole 713*a* side, that is, the X1 side, that communicates with the external wiring connection substrate holding portion 751 while passing between the adjacent ribs 510 in the circuit substrate holding portion 713. Accordingly, it is possible for the sulfur to be brought into contact with the second dummy wiring 603 provided on the surface of the rib 510 side of the circuit substrate 600 for an extended time, and possible for the sulfur to be more efficiently adsorbed on the second dummy wiring 603. Because the second accommodation space becomes distant from the exit port 752 by the notch 511, it is possible to make the sulfur infiltrating from the exit port 752 not easily enter into the second accommodation space. It is possible for the sulfur not absorbed by the first dummy wiring 742 provided on the external wiring connection substrate 740 from the sulfur that infiltrates from the exit port 752 to be absorbed by the second dummy wiring 603 of the circuit substrate 600, by providing the second dummy wiring 603 on the circuit substrate 600. Accordingly, it is possible to suppress infiltration of the sulfur infiltrating from the exit port 752 in the second accommodation space in which the flexible cable 120 is accommodated, and possible to suppress short circuiting and disconnection of the individual connection wiring 122 due to the sulfides by suppressing the formation of sulfide on the individual connection wiring 122 arranged at a particularly high density of the flexible cable 120. Concavities and convexities may be formed in the surface of the second dummy wiring 603, and, in so doing, it is possible to thereby widen the surface area of the second dummy wiring 603, and make the second dummy wiring 603 easily adsorb the sulfur.

In the embodiment, although the first dummy wiring 742 and the second dummy wiring 603 are provided on the external wiring connection substrate 740 and the circuit substrate 600, respectively, there is no particular limitation thereto, and the dummy wiring may also be provided in the flexible cable 120. In so doing, it is possible for sulfur infiltrating into the second accommodation space in which the flexible cable 120 is accommodated to be absorbed by the dummy wiring provided on the flexible cable 120, and it is further possible to suppress precipitation of the sulfide on the wiring of the individual connection wiring 122 and the like of the flexible cable 120. However, because the flexible cable 120 is reduced in size in order to achieve cost reductions and size reductions in the recording head I, there is concern of incurring increased costs and size by providing the dummy wiring. That is, because it is possible to use a small flexible cable 120 by not providing the dummy wiring in the flexible cable 120 as in the embodiment, it is possible to reduce the costs and to achieve cost reductions in the recording head I. Naturally, one or two dummy wirings may be provided on any of the external wiring connection substrate 740, the circuit substrate 600 and the flexible cable 120.

It is preferable to ground the first dummy wiring 742 provided on the external wiring connection substrate 740 and the second dummy wiring 603 provided on the circuit substrate 600. Naturally, the first dummy wiring 742 and the second dummy wiring 603 may be individually grounded, or the first dummy wiring 742 and the second dummy wiring 603 may be electrically connected, and only one of either thereof may be grounded. Grounding of the first dummy wiring 742 and the second dummy wiring 603 may be achieved by connecting to the wiring in which a portion of the wiring used to supply the head control signals is grounded. By grounding the first dummy wiring 742 and the second dummy wiring 603 in this way, it is possible to reduce the generation of noise due to floating metal when the recording head I moves and the like.

Embodiment 2

Figure 14A:
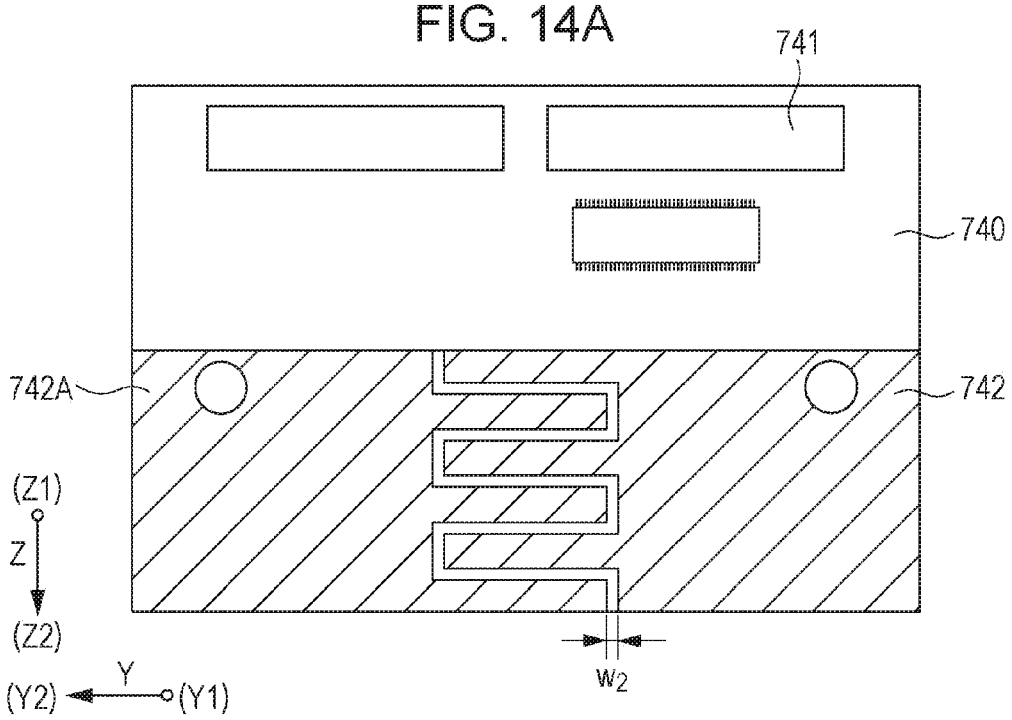
FIGS. 14A and 14B are plan views of an external wiring substrate according to Embodiment 2 of the invention.
Figure 14B:
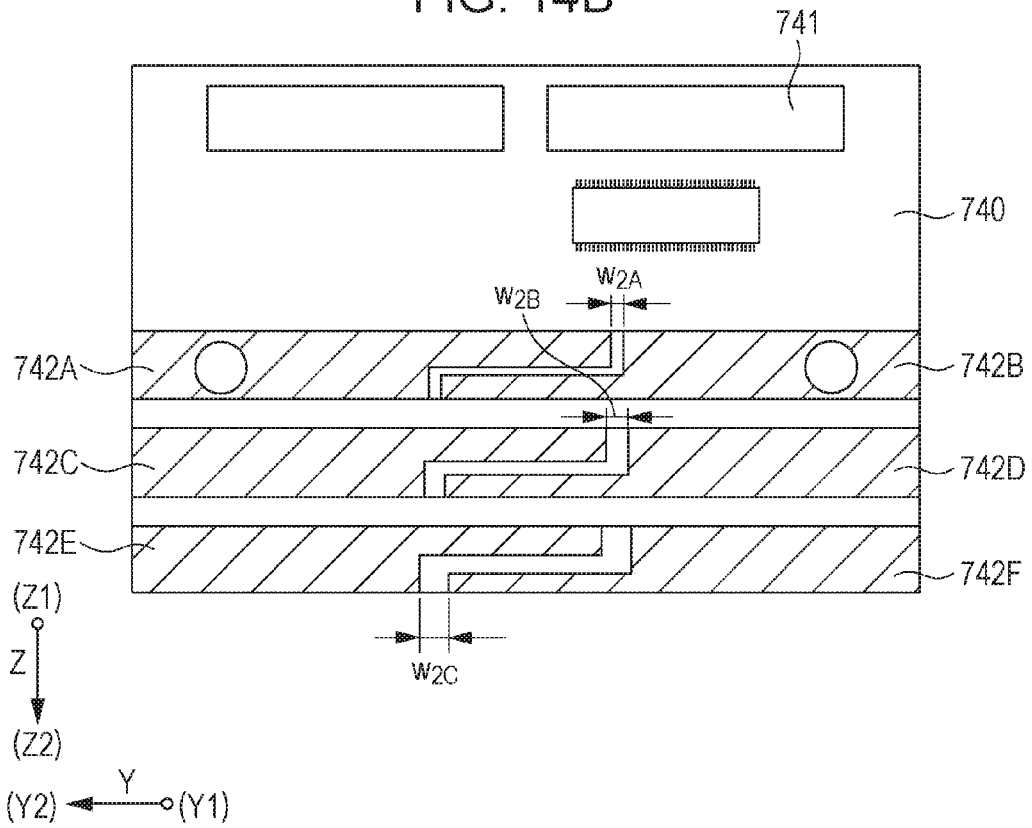

In the embodiment 2, the dummy wiring configures a portion of a detection unit, and the detection unit differentiates the detection results according to the extent of a reaction between the dummy wiring and the sulfur. Below, a configuration in which the first dummy wiring 742 provided on the external wiring connection substrate 740 will be described as the dummy wiring that configures a portion of the detection unit. FIGS. 14A and 14B are plan views of the external wiring connection substrate according to Embodiment 2 of the invention. The same members as Embodiment 1 described above are given the same reference numerals, and overlapping description will not be made.

As shown in FIG. 14A, two first dummy wirings 742A and 742B are provided spaced by a gap $w_2$ on the external wiring connection substrate 740. By arranging the two first dummy wirings 742A and 742B spaced with the gap $w_2$, and detecting the state of conduction of the two first dummy wirings 742A and 742B, it is possible to use the first dummy wirings 742A and 742B as a portion of the detection unit that detects the adsorption amount of the sulfur. That is, in a case where the amount of the sulfide is low and the sulfide is not formed straddling the two first dummy wirings 742A and 742B when sulfide is generated by sulfur being adsorbed on the two first dummy wirings 742A and 742B, the two first dummy wirings 742A and 742B are not electrically connected. In contrast, when the adsorption of the sulfur by the first dummy wirings 742A and 742B proceeds, and the sulfide grows formed straddling the two first dummy wirings 742A and 742B, the two first dummy wirings 742A and 742B are electrically connected. Therefore, by detecting the state of conduction of the two first dummy wirings 742A and 742B, it is possible to detect the adsorption amount of the sulfur to the two first dummy wirings 742A and 742B. Because the sulfur is largely adsorbed on the first dummy wirings 742A and 742B, and sulfur is also adsorbed on the wiring that supplies the head control signals in a case where it is detected that the two first dummy wirings 742A and 742B are electrically connected, an alarm such as a monitor, lamp or sound, may raise before short circuiting and disconnection of the wiring that supplies the head control signals occurs.

It is preferable that the narrowest gap $w_2$ between the adjacent first dummy wirings 742A and 742B is narrower than the narrowest gap among the wirings by which the head control signals and the like are supplied provided in the flexible cable 120, the circuit substrate 600 and the external wiring connection substrate 740. Here, the narrowest gap of the wiring is, in the embodiment, the gap $w_1$ between adjacent individual connection wirings 122 shown in FIG. 6. In this way, by making the narrowest gap $w_2$ of the first dummy wirings 742A and 742B narrower than the narrowest gap of the wirings, that is, the gap $w_1$ between the individual connection wiring 122 in the embodiment, it is possible to perform detection and raise an alarm before the adjacent individual connection wirings 122 short circuit each other.

Although two first dummy wirings 742A and 742B are provided on the external wiring connection substrate 740 in the embodiment, there is no particular limitation thereto, and three or more first dummy wirings may be provided.

A plurality of groups of two first dummy wirings 742A and 742B may be provided and the gap $w_2$ between each group may be provided with a differing gap. Examples are shown in FIG. 14B.

As shown in FIG. 14B, three groups configured by two first dummy wirings 742 are provided on the external wiring connection substrate 740. In the embodiment, each group of two first dummy wirings 742 is denoted as the first dummy wirings 742A and 742B, first dummy wirings 742C and 742D, and first dummy wirings 742E and 742F. The gap $w_{2A}$ between the two first dummy wirings 742A and 742B is the narrowest, the gap $w_{2B}$ between the two first dummy wirings 742C and 742D is wider than the gap $W_{2A}$, and the gap $w_{2C}$ between the two first dummy wirings 742E and 742F is the widest.

By providing the respective gaps $w_{2A}$, $w_{2B}$, and $w_{2C}$ between the two first dummy wirings 742A and 742B, first dummy wirings 742C and 742D, and first dummy wirings 742E and 742F that configure each group with differing gaps, it is possible to detect the amount of sulfide generated in a step-wise manner. By detecting the generation amount of the sulfide, that is, the adsorption amount of the sulfur in a step-wise manner in this way, the alarm can be raised in a step-wise manner.

By making the narrowest gap $w_{2A}$ of the two first dummy wirings 742A and 742B narrower than the narrowest gap of the wirings, that is, narrower than the gap $w_1$ between the individual connection wirings 122 in the embodiment, it is possible to perform detection and raise an alarm before the adjacent individual connection wirings 122 short circuit each other. Although three groups configured by the two first dummy wirings 742 are provided in the example shown in FIG. 14B, two groups may be provided or four or more groups may be provided.

Furthermore, although the first dummy wiring 742 provided on the external wiring connection substrate 740 is given as an example of the dummy wiring that configures the detection unit in the embodiment, there is no particular limitation thereto, and a portion of the detection unit can also be configured by forming the second dummy wirings 603 provided on the circuit substrate 600 similarly to the above-described first dummy wiring 742. Naturally, both the first dummy wirings 742 and the second dummy wirings 603 may be provided as a portion of the detection unit, or only one of either of the dummy wirings may be provided as a portion of the detection unit.

Embodiment 3

Figure 15:
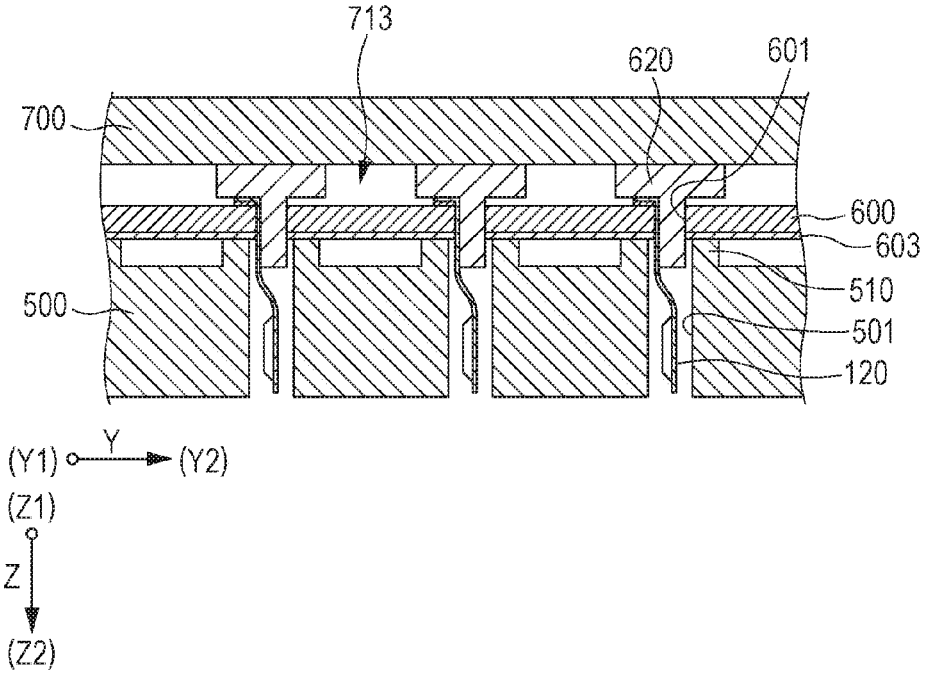
FIG. 15 is a cross-sectional view of the main portions of the recording head according to Embodiment 3 of the invention.

FIG. 15 is a cross-sectional view of the main portions of the ink jet recording head that is an example of the liquid ejecting head according to Embodiment 3 of the invention the cross-sectional view is taken along line XV-XV in FIG. 9. The same members as the above-described embodiment are given the same reference numerals, and overlapping description will not be made.

As shown in FIG. 15, the seal member 620 that blocks the connection hole 601 in the circuit substrate 600 from the surface side to which the flexible cable 120 is connected among both sides of the circuit substrate 600 is provided in the second accommodation space.

That is, the seal member 620 blocks the connection hole 601 while being inserted into the connection hole 601 from the surface of the Z1 side that is opposite the head main body 1. It is possible to use an elastic material such as a rubber or an elastomer as the seal member 620.

By blocking the connection hole 601 with the seal member 620, it is possible to suppress the infiltration of sulfur or the solvent included in the solvent-based ink in the second accommodation space in which the flexible cable 120 is accommodated from the first accommodation space. Naturally, in a case of sealing the second accommodation space, the notch 511 may not be provided in the rib 510 of the above-described Embodiment 1. Naturally, the rib 510 may not be provided. Even in a case where the second accommodation space is blocked by the seal member 620, by providing the dummy wiring on the flexible cable 120, it is possible to adsorb sulfur with the dummy wiring and suppress adsorption of the sulfur to the wiring of the individual connection wiring 122 or the like of the flexible cable 120, even if sulfur is generated by solvent infiltrating from the connection part or the like into the second accommodation space. By providing blocking the connection hole 601 with the seal member 620 and providing the notch 511 in the rib 510, it is possible for the sulfur in the second accommodation space to pass through only the notches 511 to be passed between the adjacent ribs 510 in the circuit substrate holding portion 713. Accordingly, it is possible for the sulfur to be brought into contact with the second dummy wiring 603 provided on the surface of the rib 510 side of the circuit substrate 600 for an extended time, and possible for the sulfur to be more efficiently adsorbed on the second dummy wiring 603.

In the embodiment, although an elastic material such as a rubber or an elastomer is used as the seal member 620, there is no particular limitation thereto, and it is possible to block the connection hole 601 with the adhesive. That is, the adhesive may be used as the seal member 620.

Other Embodiments

Above, although description was made of each embodiment of the invention, the basic configuration of the invention is not limited to the above description.

In each of the above-described embodiments, although five head main bodies 1 are provided in the recording head I, the number and arrangement of the head main bodies 1 is not particularly limited thereto, and a single head main body 1 may be provided in the recording head I.

In each of the above-described embodiments, although one flexible cable 120 is provided for each head main body 1, there is no particular limitation thereto, and, two or more flexible cables 120 may be provided in each head main body 1.

In each of the above-described embodiments, although two rows in which the pressure generating chambers 12 are arranged in parallel are provided in the flow channel-forming substrate 10, the is no particular limitation to the number of rows in this case. It is not important whether this is one row or three or more rows.

In each of the above-described embodiments, although description was provided using a thin film-type piezoelectric actuator 300 as the pressure generating element by which pressure changes are generated in the pressure generating chamber 12, there is no particular limitation thereto, and it is possible to use a thick film-type piezoelectric actuator formed with a method such as applying a green sheet, or a vertical vibration-type piezoelectric actuator that is compressed and expanded in the axial direction by a piezoelectric material and an electrode forming material being alternately layered, or the like. It is possible to use a pressure generating element in which a heating element is arranged in the pressure generating chamber, and that ejects liquid droplets from the nozzles through bubbles generated with the heat of the heat generating element, a so-called electrostatic actuator that generates static electricity between the diaphragm and an electrode, and ejects liquid droplets from the nozzles by deforming the diaphragm through electrostatic force, or the like as the pressure generating element.

In each of the above-described embodiments, although the flexible cable 120, the circuit substrate 600 and the external wiring connection substrate 740 are provided as substrates on which the wiring is provided, there is no particular limitation thereto, and only any one or two of these may be provided.

In each of the above-described embodiments, although the first dummy wirings 742, and 742A to 742F are provided on the external wiring connection substrate 740, and the second dummy wiring 603 is provided on the circuit substrate 600, there is no particular limitation thereto, and the other substrate on which the dummy wirings are provided may be arranged in the accommodation space. A single wiring may be arranged in the accommodation space without providing the dummy wiring on the substrate. However, as described above, by providing the dummy wiring on the substrate on which the wiring is provided, such as the external wiring connection substrate 740, the circuit substrate 600 or the like, that is providing the wiring and the dummy wiring on a common substrate, it is possible to reduce costs by reducing the number of components, and possible to achieve size reductions in the recording head I.

Figure 16:
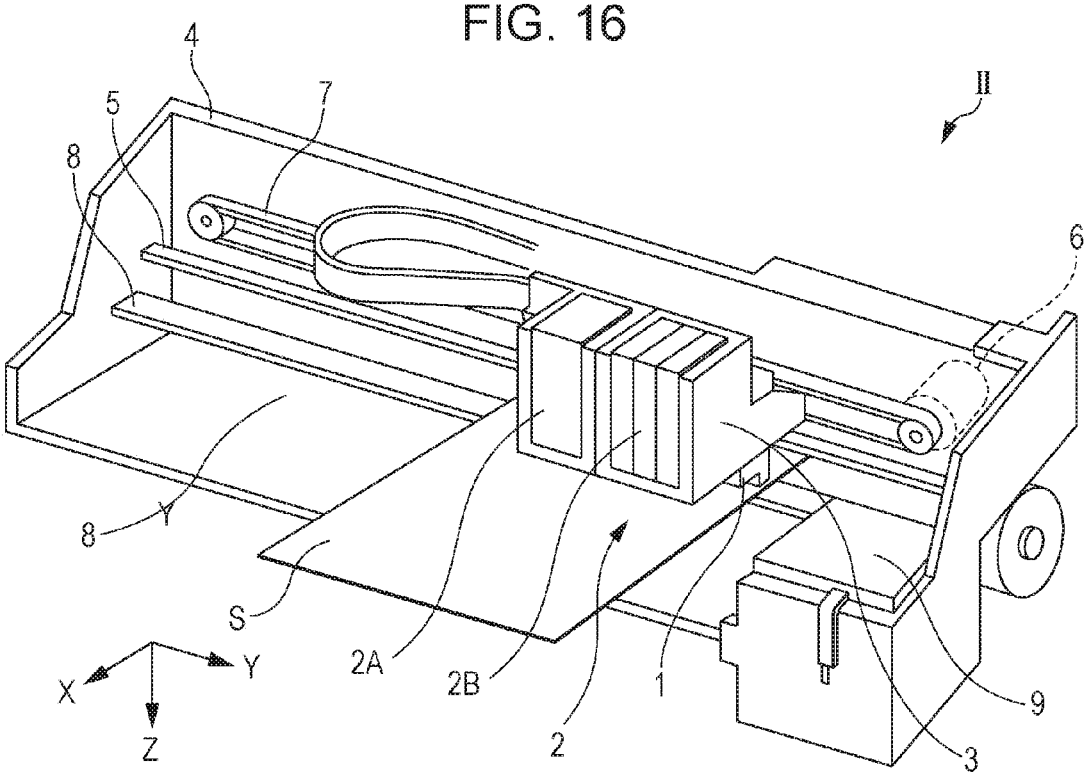
FIG. 16 is a schematic view of an ink jet recording apparatus according to an embodiment.

The recording head of the embodiment configures a portion of the ink jet recording head unit equipped with ink flow channels that communicate with the ink cartridge and the like, and is mounted on an ink jet recording apparatus. FIG. 16 is a schematic view showing an example of the ink jet-type recording apparatus.

In the ink jet-type recording apparatus II shown in FIG. 16, the ink jet recording head unit 2 (below, referred to as the head unit 2) having a plurality of recording heads I is provided so that the ink cartridges 2A and 2B configuring the ink supply unit can be mounted and removed, and a carriage 3 having the head unit 2 mounted thereon is provided so that the carriage can freely move along the carriage shaft 5 that is attached to the apparatus main body 4. The recording head unit 2 discharges a black ink composition and a color ink composition.

The carriage 3 to which the recording head unit 2 is mounted is moved along the carriage shaft 5 by the driving force of a driving motor 6 being transmitted to the carriage 3 via a plurality of gears, not shown, and a timing belt 7. Meanwhile, a transport roller 8 is provided as a transport unit in the apparatus main body 4, and a recording sheet S that is a recording medium such as a paper, is transported by the transport roller 8. The transport unit that transports the recording sheet S is not limited to a transport roller, and may be a belt, a drum, or the like.

In the above-described ink jet recording apparatus II, although an example was given of an ink jet recording head I (head unit 2) mounted to the carriage 3 and that moves in the second direction Y that is the main scanning direction, there is no particular limitation thereto, and it is possible to also apply the invention to a so-called line-type recording apparatus in which the recording head I is fixed and printing is performed by the recording sheet S such as a paper being moved in the first direction X that is the sub-scanning direction.

In the above-described example, although the ink jet recording apparatus II has a configuration in which the ink cartridges 2A and 2B that are the liquid storage unit are mounted to the carriage 3, there is no particular limitation thereto, and the liquid storage unit, such as an ink tank, may be fixed to the apparatus main body 4, and the storage unit and the ink jet recording head I may be connected via a supply pipe, such as a tube. The liquid storage unit may be not mounted to the ink jet recording apparatus.

In the above-described embodiments, although description was given exemplifying an ink jet recording head as an example of a liquid ejecting head and an ink jet recording apparatus as an example of a liquid ejecting apparatus, the invention is widely aimed at liquid ejecting apparatuses in general, and it is naturally possible to apply the invention to liquid ejecting heads that eject liquids other than ink. Examples of other liquid ejecting heads include a variety of recording heads that are used in image recording apparatuses, such as a printer; coloring material ejecting heads used to manufacture color filters, such as liquid crystal displays; electrode material ejecting heads used to form electrodes, such as organic EL displays and field emission displays (FED), biological organic substance ejecting heads used to manufacture bio chips, and the like, and it is possible to apply the invention to liquid ejecting apparatuses provided with these liquid ejecting heads.

What is claimed is:

1. A liquid ejecting head, comprising:

a driving element for ejecting a liquid from a nozzle;

a wiring electrically connected to the driving element, at least part of the wiring being covered with at least one of a plating layer and an insulating film;

an accommodation space that accommodates at least a portion of the wiring; and a dummy wiring which is arranged in the accommodation space, a surface of the dummy wiring, which is not covered, being exposed to the accommodation space and adsorbing sulfur, wherein at least one of (a), (b) and (c) is satisfied where (a) the dummy wiring is grounded, (b) concavities and convexities are formed on a surface of the dummy wiring, and (c) the accommodation space has an exit port that communicates with the atmosphere, and the dummy wiring is provided on a side closer to the exit port to a connecting portion to which the wiring and the driving element are connected.

2. The liquid ejecting head according to claim 1, wherein a plurality of each of the dummy wirings and the wirings is provided, and the narrowest gap between the dummy wirings adjacent to one another is narrower than the narrowest gap between the wirings adjacent to one another.

3. A liquid ejecting apparatus comprising the liquid ejecting head according to claim 2.

4. The liquid ejecting head according to claim 1, wherein at least a portion of the dummy wiring and the wiring is provided on a common rigid substrate.

5. The liquid ejecting head according to claim 4, wherein the rigid substrate is connected to a flexible cable that is connected to the driving element from the wirings, and the dummy wiring is provided on the surface of an opposite side to the surface to which the flexible cable is connected.

6. The liquid ejecting head according to claim 5, wherein the accommodation space includes a first accommodation space that accommodates the rigid substrate, and a second accommodation space that accommodates the flexible cable, the rigid substrate includes a through port that the flexible cable passes through, a rib that supports the rigid substrate from a surface on an opposite side to a surface of the side to which the flexible cable is bonded from both surfaces of the rigid substrate is provided in the first accommodation space, and the rib causes the rigid substrate to be separated from a wall surface of the first accommodation space.

7. The liquid ejecting head according to claim 6, wherein the accommodation space includes an exit port closer to the first accommodation space than the second accommodation space, and the rib is provided along an edge of the through port and a notch is provided on a side of the rib far from the exit port of the accommodation space of the through port.

8. The liquid ejecting head according to claim 6, wherein a seal member that blocks the through port of the rigid substrate from a surface of the side to which the flexible cable is bonded from both surfaces of the rigid substrate is provided in the second accommodation space.

9. The liquid ejecting head according to claim 6, wherein a filler that covers at least a portion of the flexible cable is provided in the second accommodation space.

10. A liquid ejecting apparatus comprising the liquid ejecting head according to claim 6.

11. A liquid ejecting apparatus comprising the liquid ejecting head according to claim 5.

12. A liquid ejecting apparatus comprising the liquid ejecting head according to claim 4.

13. A liquid ejecting apparatus comprising the liquid ejecting head according to claim 1.

14. A liquid ejecting head, comprising:

a driving element for ejecting a liquid from a nozzle;

a wiring electrically connected to the driving element;

an accommodation space that accommodates at least a portion of the wiring; and a dummy wiring which is arranged in the accommodation space and adsorbs sulfur, wherein the dummy wiring configures a portion of a detection unit, and the detection unit differentiates a detection result according to the extent of a reaction between the dummy wiring and the sulfur.

15. The liquid ejecting head according to claim 14, wherein the dummy wiring is grounded.

16. The liquid ejecting head according to claim 14, wherein concavities and convexities are formed on a surface of the dummy wiring.

17. A liquid ejecting apparatus comprising the liquid ejecting head according to claim 14.

18. The liquid head according to claim 14, wherein the accommodation space has an exit port that communicates with the atmosphere, and the dummy wiring is provided on a side closer to the exit port than to a connecting portion to which the wiring and the driving element are connected.

19. A liquid ejecting head, comprising:

a driving element for ejecting a liquid from a nozzle;

a wiring electrically connected to the driving element;

an accommodation space that accommodates at least a portion of the wiring;

a rigid substrate disposed in the accommodation space and having a first side that faces the driving element; and a dummy wiring which is arranged in the accommodation space and adsorbs sulfur, wherein at least a portion of the dummy wiring is provided on the first side of the rigid substrate, and wherein the wiring is connected to a second side of the rigid substrate, the second side being opposed to the first side.

20. A liquid ejecting head according to claim 19, wherein at least part of the wiring is formed with a flexible cable.

* * * * *